United States Patent [19]

Yagihara et al.

[11] Patent Number: 4,923,789

[45] Date of Patent: May 8, 1990

[54] SILVER HALIDE PHOTOGRAPHIC MATERIAL

[75] Inventors: Morio Yagihara; Tetunori Matushita; Toshinao Ukai; Kazunobu Katoh, all of Kanagawa, Japan

[73] Assignee: Fuji Photo Film Co., Ltd., Kanagawa, Japan

[21] Appl. No.: 193,443

[22] Filed: May 12, 1988

[30] Foreign Application Priority Data

May 13, 1987 [JP] Japan ..... 62-116180

[51] Int. Cl.[5] ..... G03C 1/06; G03C 1/84

[52] U.S. Cl. ..... 430/517; 430/223; 430/559; 430/955; 430/958

[58] Field of Search ..... 430/223, 517, 955, 958, 430/559

[56] References Cited

U.S. PATENT DOCUMENTS 4,363,865 12/1982 Reczek et al. ..... 430/223
4,518,685 5/1985 Yagihara et al. ..... 430/505
4,554,243 11/1985 Ono et al. ..... 430/543
4,659,651 4/1987 Yagihara et al. ..... 430/542

*Primary Examiner*—Paul R. Michl
*Assistant Examiner*—Janet C. Baxter
*Attorney, Agent, or Firm*—Sughrue, Mion, Zinn, MacPeak & Seas

[57] ABSTRACT

A silver halide photographic material comprising a support having thereon at least one silver halide light-sensitive emulsion layer, wherein at least one compound represented by the formula (I) is present in said silver halide emulsion layer or at least one other hydrophilic colloid layer of said material:

A—B (I)

wherein A represents a blocking group which can release a dye for photographic purposes during processing and B represents said dye for photographic purposes which is bonded to A by means of a hetero atom.

8 Claims, No Drawings

SILVER HALIDE PHOTOGRAPHIC MATERIAL

FIELD OF THE INVENTION

This invention concerns a silver halide photographic material, and more precisely it concerns a silver halide photographic material which has at least one layer included effectively among the layers of the light-sensitive material which contains a novel light absorbing compound which can be decolorized in development processing such a way that there is no residual color staining.

BACKGROUND OF THE INVENTION

The inclusion of light absorbing compounds in silver halide emulsion layers or other hydrophilic colloid layers to absorb light of a specified wavelength has generally been a characteristic of silver halide photographic materials in the past for the purpose of adjusting speed, increasing the level of safety to safe-lighting, adjusting the color temperature of light, preventing halation, or for adjusting the speed balance in multilayer color photographic materials.

For example, silver halide photographic materials consist of hydrophilic colloid layers such as light-sensitive silver halide emulsion layers which are formed on a support, but when imagewise exposures are made to record images in the light-sensitive silver halide emulsion layers it is necessary to control the spectral composition of the light which is directed onto the silver halide emulsion layers in order to increase the photographic speed. In such a case, use is made of a method in which a dye which absorbs light of the wavelength region which is not required in the silver halide emulsion layer is included in a hydrophilic colloid layer which is located on the side farther away from the support than the aforementioned light-sensitive silver halide emulsion layer as a filter layer so that only light in the wavelength region which is required is transmitted to the silver halide emulsion layer.

Furthermore, an anti-halation layer is intended to improve image sharpness and such a layer is positioned between the light-sensitive emulsion layer and the support, or on the back of the support, where it absorbs harmful reflections from the interface between the emulsion layer and the support or from the back of the support, and thereby increases image sharpness.

Further, dyes which absorb light in the wavelength region to which the silver halide is sensitive can be used in the silver halide emulsion layers for anti-irradiation purposes in order to increase image sharpness.

Moreover, dyes which absorb UV light and visible light can be added to a light-sensitive layer or to a layer which is positioned between the light source and a light-sensitive layer in order to raise the level of safety with respect to safe-lights of the silver halide photographic materials, and more precisely the light-sensitive materials for bright room, which are used in photomechanical processes.

Furthermore, the dyes may be added to hydrophilic colloid layers which are positioned between the light-sensitive silver halide emulsion layer and the support for anti-halation purposes.

The dyes which are used for such purposes must satisfy a number of conditions. Thus, they must be decolorized during the photographic development process, readily dissolve out of the silver halide photographic material, and there should be essentially no residual color staining by the dye after processing. Moreover, they should not have any adverse effects on the photographic emulsion, such as fogging or desensitization, etc.; they should not diffuse from the colored layer into other layers; they should have appropriate spectral absorption characteristics for the intended purpose; and they should have excellent stability with respect to the passage of time in solution or in the silver halide photographic material with no degeneration.

Much work has been done in connection with the discovery of dyes which satisfy these conditions. For example, there are the pyrazolone oxonol dyes disclosed in British Pat. 506,385, the barbituric acid oxonol dyes disclosed in U.S. Pat. 3,247,127, the azo dyes disclosed in U.S. Pat. 2,390,707, the styryl dyes disclosed in U.S. Pat. 2,255,077, the hemioxonol dyes disclosed in British Pat. 584,609, the merocyanine dyes disclosed in U.S. Pat. 2,493,747, the cyanine dyes disclosed in U.S. Pat. 2,843,486, the methylene type benzylidene dyes disclosed in U.S. Pat. 4,420,555, etc.

In cases where layers which contain the above mentioned dyes function as filter layers or anti-halation layers, the layer must be colored selectively and there must be effectively no coloration of the other layers. This is because if other layers are colored, not only does this have a spectrally harmful effect on the other layers but it also reduces the effectiveness of the layer as a filter layer or anti-halation layer. Furthermore, if a dye which has been added to a certain layer for preventing irradiation diffuses out of the layer and colors other layers, this also gives rise to problems of the same type as mentioned above.

Methods in which a so-called acidic dye which has sulfo groups or carboxyl groups is localized in a specified layer using a mordant were known in the past as a means of overcoming this problem.

The ethylenic unsaturated compound polymers which have dialkylaminoalkyl ester residual groups disclosed in British Pat. 685,475, the reaction products of poly(vinyl alkyl ketones) and aminoguanidine disclosed in British Pat. 850,281, and the vinylpyridine polymers and vinylpyridinium cation polymers disclosed in the specifications of U.S. Pats. 2,548,564, 2,484,430 3,148,061 and 3,756,814 etc. are known as mordants of this type, and cation based mordants in which secondary or tatiary amino groups, nitrogen-containing heterocyclic groups and quaternary cations thereof are contained in a polymer can be used in such a way as to fix effectively the acidic dyes mentioned earlier.

However, these cation based mordants undergo an electrostatic interaction with gelatin which is often used as the hydrophilic colloid and with the surfactants which have alcoholate groups, carboxylate groups, sulfonate groups or sulfate groups which are normally employed as coating aids and there have been cases in which this has had an adverse effect on coating properties.

There have also been cases where these compounds have caused a poor desilvering and reduced speed in adjacent emulsion layers in color light-sensitive materials.

Furthermore, the acidic dyes mentioned earlier have often been observed to diffuse into other layers with mordants of this type and the use of large amounts of mordant has been considered as a way of stopping this diffusion. However not only is it impossible to stop diffusion from occurring completely with this method but it also increases the thickness of the layer in which the mordant is present and this is disadvantageous in that it inevitably results in reduced sharpness.

Moreover, with the sensitive materials used for photomechanical processes of printing, the operation in which a reducing bath is used known as reduction, is normally carried out in order to adjust density, gradation, etc. However water-soluble iron complexes are present in such reducing baths as reducers, and when a cation based mordant of the type mentioned earlier is used, it bonds electrostatically with the iron complexes and this is disadvantageous in that it results in yellow staining by the iron complex.

SUMMARY OF THE INVENTION

Hence, the first object of the invention is to provide a silver halide photographic material which has at least one layer which is colored with a dye, in which the diffusion of this dye to other layers is inhibited, in which the dye is decolorized during photographic development processing, being washed out from the silver halide photographic material, and with which there is essentially no post development process staining.

The second object of the invention is to provide a silver halide photographic material which contains at least one layer which is colored with a dye of which interaction with gelatin and coating aids is inhibited and with which the coating properties are improved The third object of the invention is to provide a silver halide photographic material in which desilvering property is improved and loss of speed in adjacent emulsion layers is suppressed.

The fourth object of the invention is to provide a silver halide photographic material in which color staining in reducing baths during a reducing process is inhibited.

The above mentioned objects of the invention are realized by providing a silver halide photographic material comprising a support having thereon at least one silver halide light-sensitive emulsion layer, wherein at least one compound represented by the formula (I) is present in the silver halide light-sensitive emulsion layer or at least one other hydrophilic colloid layer of the material:

$$A—B \qquad (I)$$

wherein A represents a blocking group which can release a dye for photographic purposes during processing and B represents the dye for photographic purposes which is bonded to A by means of a hetero atom.

DETAILED DESCRIPTION OF THE INVENTION

Any of the known blocking groups can be used for the blocking group. For example it may be any of the blocking groups in which acyl groups and sulfonyl groups are used as blocking groups as disclosed in Japanese Pat. Publication No. 9968/73, Japanese patent application (OPI) Nos. 8828/77 and 82834/82 (the term "OPI" as used herein means a "published unexamined Japanese patent application"), U.S. Pat. 3,311,476 and Japanese Pat. Publication No. 44805/72 (U.S. Pat. 3,615,617); any of the blocking groups in which a so-called reverse Michael reaction is used as disclosed in Japanese Pat. Publication Nos. 17369/80 (U.S. Pat. 3,888,677), 9696/80 (U.S. Pat. 3,791,830) and 34927/80 (U.S. Pat. 4,009,029) and Japanese patent application (OPI) Nos. 77842/81 (U.S. Pat. 4,307,175), 105642/84 and 105640/84; any of the blocking groups in which the formation of a quinone methide or quinone methide type compounds by means of an intramolecular electron transfer is used as disclosed in Japanese Pat. Publication No. 39727/79, U.S. Pats. 3,674,478, 3,932,480 and 3,993,661 and Japanese patent application (OPI) Nos. 135944/82, 135945/82 and 136640/82; any of those in which an intramolecular ring closing reaction is used as disclosed in Japanese patent application (OPI) Nos. 53330/80 and 218439/84; any of those in which the ring opening of a five or six membered ring is used as disclosed in Japanese patent application (OPI) Nos. 76541/82 (U.S. Pat. 4,335,200), 135949/82, 179842/82, 137945/84, 140445/84, 219741/84 and 41034/85; and any of the blocking groups in which the addition of a nucleophilic agent to an unsaturated bond is used as disclosed in Japanese patent application (OPI) Nos. 201057/84, 43739/86 and 95347/86.

The formula (I) can be represented in more detail by the formula (II).

$$A—(X_1)_{m_1}D \qquad (II)$$

wherein D represents a dye for photographic purposes which has been bonded to $X_1$ by means of a hetero atom of the dye D, $X_1$ represents a divalent linking group which is bonded to A by means of a hetero atom of the divalent linking group $X_1$, and $m_1$ represents 0 or 1.

The dye for photographic purposes represented by D has a hetero atom and is bonded by the hetero atom, and the dye itself does not dye the layer to which it is added selectively and it essentially leaves no stain or residual coloration on washing out from the light-sensitive material or undergoing a decolorizing reaction as a result of photographic processing (the processes of development, bleaching, fixing, water washing, etc.).

That is to say, a compound of this invention in the blocked state as represented by the formula (I) or the formula (II) is fast to diffusion and can dye the layer to which it has been added selectively, but it is distinguished by the fact that the dye unit represented by B or D is itself diffusible.

Examples of the dye include, for example, the compounds disclosed on pages 197 to 211 of *Highly Functional Photochemicals, "Structure Function and Possible Applications"*, (CMC, 1986).

Actual examples of dyes for photographic purposes include, for example, arylidene based dyes, styryl based dyes, butadiene based dyes, oxonol based dyes, cyanine based dyes, merocyanine based dyes, hemicyanine based dyes, diarylmethane based dyes, triarylmethane based dyes, azomethine based dyes, azo based dyes, metal chelate based dyes, anthraquinone based dyes, stilbene based dyes, chalcone based dyes, indophenol based dyes, indoaniline based dyes, coumarin based dyes, etc.

The dye for photographic purposes represented by D may be bonded directly to A by means of a hetero atom (i.e., $m_1$ is 0) or it may be bonded by means of $X_1$ (i.e., $m_1$ is 1).

$X_1$ represents a divalent linking group and it is bonded by means of a hetero atom, representing a group which releases D quickly after cleavage as X—D during processing.

Linking groups of this type include those which release D by means of an intramolecular ring closing reaction as disclosed in Japanese patent application (OPI) No. 145135/79 (British patent application 2,010,818A), U.S. Pats. 4,248,962 and 4,409,323 and British Pat. 2,096,783, those which release D by means of an intramolecular electron transfer as disclosed in British Pat. 2,072,363 and Japanese patent application (OPI) No. 154234/82, those which release D along with the elimination of carbon dioxide as disclosed in Japanese patent application (OPI) No. 179842/82, and those which release D along with the elimination of formalin as disclosed in Japanese patent application (OPI) No. 93422/84. The structural formulae of $X_1$ groups typical of those mentioned above are shown together with D below.

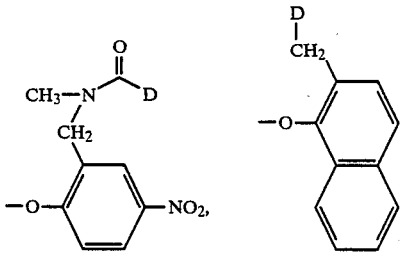

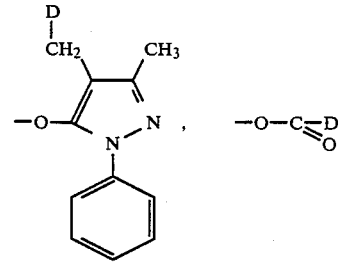

$-OCH_2-D$, $-O-\overset{O}{\overset{\|}{C}}-OCH_2-D$

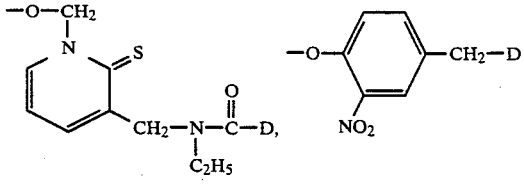

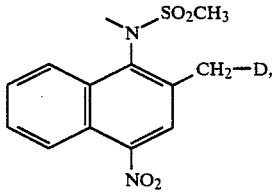

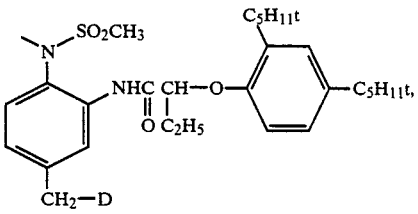

-continued

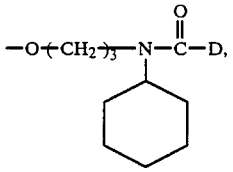

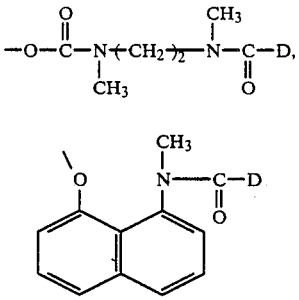

The preferred blocked dyes for photographic purposes, which are represented by formula (II) in this invention have at least one

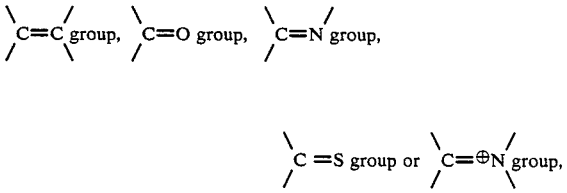

and they are compounds which release the dye for photographic purposes as a result of the attack by a nucleophilic substance (typically an $OH^-$ ion) on the carbon atom of the functional groups and a following reaction, and of these compounds those which can be represented by the formulae (III) and (IV) below are especially desirable.

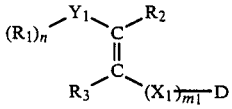

(III)

wherein $R_1$, $R_2$ and $R_3$ each represents a hydrogen atom or a substituent and $R_1$ and $R_2$, and $R_1$ and $R_3$, may be bonded together to form a carbocyclic or heterocyclic ring. $Y_1$ represents

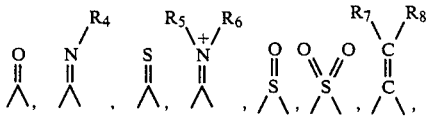

a cyano group or a nitro group (wherein $R_4$, $R_5$, $R_6$, $R_7$ and $R_8$ each represents a hydrogen atom or a substituent); n represents 0 or 1; and $X_1$, D and $m_1$ have the same meaning as in formula (II).

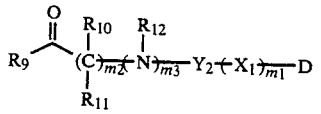

(IV)

wherein $R_9$ represents a hydrogen atom, an alkyl group, an alkenyl group, an aryl group, a cycloalkyl group or a heterocyclic group; $R_{10}$, $R_{11}$ and $R_{12}$ each represents a hydrogen atom or a substituent; $Y_2$ represents a carbonyl group or a sulfonyl group; $m_2$ represents an integer of 1 to 4; $m_3$ represents 0 or 1; and $X_1$, D and $m_1$ have the same meaning as in formula (II).

Formula (III) is described in detail below.

$R_1$ represents a hydrogen atom or a substituent and the substituent may be an alkyl group (preferably an alkyl group which has from 1 to 20 carbon atoms), an alkenyl group (preferably an alkenyl group which has from 2 to 20 carbon atoms), an aryl group (preferably an aryl group which has from 6 to 20 carbon atoms), alkoxy group (preferably an alkoxy group which has from 1 to 20 carbon atoms), an aryloxy group (preferably an aryloxy group which has from 6 to 20 carbon atoms), an alkylthio group (preferably an alkylthio group which has from 1 to 20 carbon atoms), an arylthio group (preferably an arylthio group which has from 6 to 20 carbon atoms), an amino group (an unsubstituted amino group or, preferably, a secondary or tertiary amino group substituted with alkyl group(s) which have from 1 to 20 carbon atoms or aryl group(s) which have from 6 to 20 carbon atoms), or a hydroxyl group. These substituents may have one or more of the substituents described below, and when there are two or more such substituents described below they may be the same or different.

Substituents for $R_1$ include halogen atoms (fluorine, chlorine, bromine), alkyl groups (preferably those which have from 1 to 20 carbon atoms), aryl groups (preferably those which have from 6 to 20 carbon atoms), alkoxy groups (preferably those which have from 1 to 20 carbon atoms), aryloxy groups (preferably those which have from 6 to 20 carbon atoms), alkylthio groups (preferably those which have from 1 to 20 carbon atoms), arylthio groups (preferably those which have from 6 to 20 carbon atoms), acyl groups (preferably those which have from 2 to 20 carbon atoms), acylamino groups (preferably alkanoylamino groups which have from 1 to 20 carbon atoms and benzoylamino groups which have from 6 to 20 carbon atoms), nitro groups, cyano groups, oxycarbonyl groups (preferably alkoxycarbonyl groups which have from 1 to 20 carbon atoms and aryloxycarbonyl groups which have from 6 to 20 carbon atoms), hydroxyl groups, carboxyl groups, sulfo groups, ureido groups (preferably alkylureido groups which have from 1 to 20 carbon atoms and arylureido groups which have from 6 to 20 carbon atoms), sulfonamido groups (preferably alkylsulfonamido groups which have from 1 to 20 carbon atoms and arylsufonamido groups which have from 6 to 20 carbon atoms), sulfamoyl groups (preferably alkylsulfamoyl groups which have from 1 to 20 carbon atoms and arylsulfamoyl groups which have from 6 to 20 carbon atoms), carbamoyl groups (Preferably alkylcarbamoyl groups which have from 1 to 20 carbon atoms and arylcarbamoyl groups which have from 6 to 20 carbon atoms), acyloxy groups (preferably those which have from 1 to 20 carbon atoms), amino groups (unsubstituted amino groups, or preferably secondary or tertiary amino groups substituted with alkyl group(s) which have from 1 to 20 carbon atoms or aryl group(s) which have from 6 to 20 carbon atoms), carbonic acid ester groups (preferably alkyl carbonic acid esters which have from 1 to 20 carbon atoms and aryl carbonic acid esters which have from 6 to 20 carbon atoms), sulfone groups (preferably alkylsulfone groups which have from 1 to 20 carbon atoms and arylsulfone groups which have from 6 to 20 carbon atoms), and sulfinyl groups (preferably alkylsulfinyl groups which have from 1 to 20 carbon atoms and arylsulfinyl groups which have from 6 to 20 carbon atoms).

Moreover, $R_1$ may be bonded to $R_2$ or $R_3$ to form a carbocyclic or heterocyclic ring (for example a 5 to 7 membered ring).

$R_2$ and $R_3$ may be the same or different and each represents a hydrogen atom or a substituent, and the substituents include halogen atoms (fluorine, chlorine, bromine), alkyl groups (preferably those which have from 1 to 20 carbon atoms), aryl groups (preferably those which have from 6 to 20 carbon atoms), alkoxy groups (preferably those which have from 1 to 20 carbon atoms), aryloxy groups (preferably those which have from 6 to 20 carbon atoms), alkylthio groups (preferably those which have from 1 to 20 carbon atoms), arylthio groups (preferably those which have from 6 to 20 carbon atoms), acyloxy groups (preferably those which have from 2 to 20 carbon atoms), amino groups (unsubstituted amino groups or preferably secondary or tertiary amino groups substituted with alkyl group(s) which have from 1 to 20 carbon atoms or aryl group(s) which have from 6 to 20 carbon atoms), carbonamido groups (preferably alkylcarbonamido groups which have from 1 to 20 carbon atoms and aryl carbonamido groups which have from 6 to 20 carbon atoms), ureido groups (preferably alkylureido groups which have from 1 to 20 carbon atoms and arylureido groups which have from 6 to 20 carbon atoms), carboxyl groups, carbonic acid ester groups (preferably alkyl carbonic acid esters which have from 1 to 20 carbon atoms and aryl carbonic acid esters which have from 6 to 20 carbon atoms), oxycarbonyl groups (preferably alkyloxycarbonyl groups which have from 1 to 20 carbon atoms and aryloxycarbonyl groups which have from 6 to 20 carbon atoms), carbamoyl groups (preferably alkylcarbamoyl groups which have from 1 to 20 carbon atoms and arylcarbamoyl groups which have from 6 to 20 carbon atoms), acyl groups (preferably alkylcarbonyl groups which have from 1 to 20 carbon atoms and arylcarbonyl groups which have from 6 to 20 carbon atoms), sulfo groups, sulfonyl groups (preferably alkylsulfonyl groups which have from 1 to 20 carbon atoms and arylsulfonyl groups which have from 6 to 20 carbon atoms), sulfinyl groups (preferably alkylsulfinyl groups which have from 1 to 20 carbon atoms and arylsulfinyl groups which have from 6 to 20 carbon atoms), sulfamoyl groups (preferably alkylsulfamoyl groups which have from 1 to 20 carbon atoms and arylsulfamoyl groups which have from 6 to 20 carbon atoms), cyano groups and nitro groups.

The substituents represented by $R_2$ and $R_3$ may have one or more substituents and when there are two or more substituents on $R_2$ or $R_3$, these may be the same or different. Actual examples of such substituents are the same as the aforementioned substituents for $R_1$. $Y_1$ represents

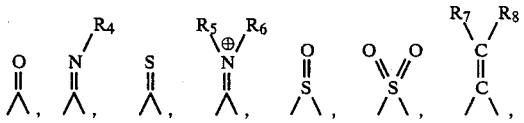

a cyano group or a nitro group, and the groups $R_4$, $R_5$, $R_6$, $R_7$ and $R_8$ may be all the same or different, each representing a hydrogen atom or a substituent, and actual examples of substituents include alkyl groups (preferably those which have from 1 to 20 carbon atoms), alkenyl groups (preferably those which have from 2 to 20 carbon atoms), aryl groups (preferably those which have from 6 to 20 carbon atoms), alkoxy groups (preferably those which have from 1 to 20 carbon atoms), aryloxy groups (preferably those which have from 6 to 20 carbon atoms), acyloxy groups (preferably those which have from 2 to 20 carbon atoms), amino groups (an unsubstituted amino group, or preferably secondary or tertiary amino groups substituted with alkyl group(s) which have from 1 to 20 carbon atoms or aryl group(s) which have from 6 to 20 carbon atoms), carbonamido groups (preferably alkylcarbonamido groups which have from 1 to 20 carbon atoms and arylcarbonamido groups which have from 6 to 20 carbon atoms), ureido groups (preferably alkylureido groups which have from 1 to 20 carbon atoms and arylureido groups which have from 6 to 20 carbon atoms), oxycarbonyl groups (preferably alkyloxycarbonyl groups which have from 1 to 20 carbon atoms and aryloxycarbonyl groups which have from 6 to 20 carbon atoms), carbamoyl groups (preferably alkylcarbamoyl groups which have from 1 to 20 carbon atoms and arylcarbamoyl groups which have from 6 to 20 carbon atoms), acyl groups (preferably alkylcarbonyl groups which have from 1 to 20 carbon atoms and arylcarbonyl groups which have from 6 to 20 carbon atoms), sulfonyl groups (preferably alkylsulfonyl groups which have from 1 to 20 carbon atoms and arylsulfonyl groups which have from 6 to 20 carbon atoms), sulfinyl groups (preferably alkylsulfinyl groups which have from 1 to 20 carbon atoms and arylsulfinyl groups which have from 6 to 20 carbon atoms) and sulfamoyl groups (preferably alkylsulfamoyl groups which have from 1 to 20 carbon atoms and arylsulfamoyl groups which have from 6 to 20 carbon atoms). Of these, the preferred substituents for R7 and $R_8$ are oxycarbonyl groups, carbamoyl groups, acyl groups, sulfonyl groups, sulfamoyl groups, sulfinyl groups, cyano groups and nitro groups. These substituents may have one or more substituents and when there are two or more substituents they may be the same or different. Actual examples of substituents are the same as the aforementioned substituents for $R_1$.

Those of the compounds represented by formula (III) which can be represented by the formulae (V) and (VI) are preferred.

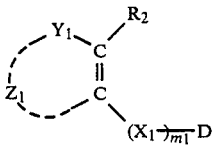

(V)

-continued

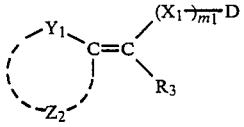

(VI)

$Z_1$ in formula (V) represents a group of atoms which forms a carbocyclic or heterocyclic ring.

Actual examples include five, six or seven membered carbocyclic rings and five, six or seven membered heterocyclic rings which contain one or more nitrogen atoms, oxygen atoms or sulfur atoms, and condensed forms of these carbocyclic or heterocyclic rings with the condensed rings formed in an appropriate position.

Actual examples include cyclopentenone, cyclohexenone, cycloheptenone, benzocycloheptenone, benzocyclopentenone, benzocyclohexenone, 4-pyridone, 4-quinolone, 2-pyrone, 4-pyrone, 1-thio-2-pyrone, 1-thio-4-pyrone, coumarin, chromane, uracil etc. and also

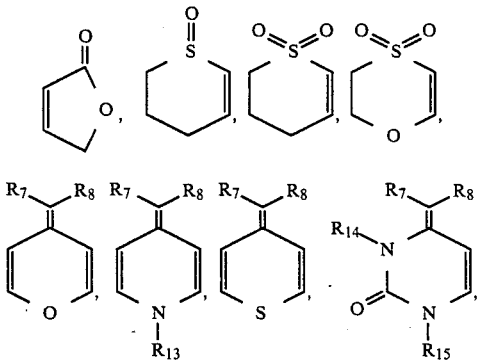

etc. $R_{13}$, $R_{14}$ and $R_{15}$ each represents a hydrogen atom, an alkyl group, an alkenyl group, an aryl group, an aralkyl group, an acyl group, etc., and $R_7$ and $R_8$ have the same meaning as defined above with respect to the substituent $Y_1$.

These carbocyclic or heterocyclic rings may have one or more substituents and when there are two or more substituents they may be the same or different. Actual examples of these substituents include those mentioned earlier as substituents for $R_1$.

$Z_2$ in the formula (VI) has the same meaning as $Z_1$ in formula (V) and actual examples include cyclopentanone, cyclohexanone, cycloheptanone, benzocycloheptanone, benzocyclopentanone, benzocyclohexanone, 4-tetrahydropyridone, 4-dihydroquinolone, 4-tetrahydropyrone, etc. These carbocyclic or heterocyclic rings may have one or more substituents and when there are two or more substituents they may be the same or different. Actual examples of these substituents are the same as the aforementioned substituents for $R_1$.

$R_2$, $R_3$, $Y_1$, $X_1$, D and $m_1$ have the same meaning as in the formula (III).

The formula (IV) is described in detail below.

$R_9$ represents a hydrogen atom or a groups which is bonded with a carbon atom, and actual examples of such groups include alkyl groups, alkenyl groups, aryl groups, cycloalkyl groups and heterocyclic groups, and $R_9$ is preferably a hydrogen atom, an alkyl group which has from 1 to 17 carbon atoms, an alkenyl group which has from 3 to 17 carbon atoms, a phenyl group which has from 6 to 21 carbon atoms or a heterocyclic group which has from 4 to 21 carbon atoms.

$R_{10}$, $R_{11}$ and $R_{12}$ each represents a hydrogen atom or a substituent. Actual examples of substituents are the same as the aforementioned substituents for $R_4$ to $R_8$. $R_{10}$ and $R_{11}$ may be the same or different and they are preferably hydrogen atoms, halogen atoms, alkyl groups, alkenyl groups, phenyl groups, hydroxyl groups, alkoxy groups or acyl groups. These substituents may further have substituents and a double bond or a ring may be formed with $R_{10}$ and $R_{11}$. Furthermore, when $m_2$ has an integer of from 2 to 4, the carbon atom onto which $R_{10}$ and $R_{11}$ is substituted can form a cycloalkyl group, an aromatic ring or a heterocyclic ring.

$R_{12}$ preferably represents an alkyl group, an alkenyl group or a phenyl group.

$R_9$, $R_{10}$, $R_{11}$ and $R_{12}$ may be joined together to form rings provided that the oxygen atom of the carbonyl group is able to make a nucleophilic attack on $Y_2$.

$R_{10}$ and $R_{11}$ most desirably represent hydrogen atoms, halogen atoms or alkyl groups, a phenyl ring is the most desirable ring formed with the carbon atom onto which $R_{10}$ and $R_{11}$ are substituted.

$R_{12}$ most desirably represents an alkyl group which has from 1 to 18 carbon atoms or a phenyl group which has from 6 to 21 carbon atoms.

$Y_2$ represents a carbonyl group or a sulfonyl group and it preferably represents a carbonyl group.

Moreover, $m_2$ is an integer of 1 to 4 and $m_3$ has a value of 0 or 1.

Furthermore, $m_2$ preferably is an integer of 1 to 3, and $m_3$ is 1 when $m_2$ is 1; 0 or 1 when $m_2$ is 2; and 0 when $m_2$ is 3. When $m_2$ is 2 or 3 the $R_{10}$-C-$R_{11}$ units may be different structures.

Of the compounds represented by the formulae (III) and (IV), those represented by the formula (III) are preferred.

There is no risk of adverse effects on photographic performance due to the layers which contain the compounds of this invention since the compound are easily decolorized or washed out by photographic processing.

The coating properties are also good since in this invention the compounds have little interaction with binders, such as gelatin and coating aids.

Furthermore, there are no adverse effects such as staining even when a treatment involving the use of a reducer is carried out.

Moreover, the silver halide photographic materials of this invention provide images of increased sharpness. Furthermore, photographs obtained with silver halide photographic materials of this invention are not liable to staining and there is no loss of photographic performance, the materials being stable even in long term storage.

The selection of $R_1$, $R_2$, $R_3$, $R_4$, $R_5$, $R_6$, $R_7$, $R_8$, $R_9$, $R_{10}$, $R_{11}$ and $R_{12}$ in the formulae (III), (IV), (V) and (VI) is made in accordance with the pH and composition of the processing baths used for processing the photographic element which contains the light absorbing compound of formula (I) and the timing period which is required. The pH of the processing bath differs in development, bleaching, fixing, etc., but it is normally within the range from 3.0 to 13.0 and preferably within the range from 5.0 to 12.5. Hence a distinguishing feature of the compounds of this invention is that the dye unit can be released by a processing bath which has such a comparatively low pH.

In the silver halide photographic materials of this invention, the light absorbing compounds represented by the formula (I) of the invention selectively dye the layer in which they are contained and there is the beneficial effect that essentially no diffusion of the compounds to other layers occurs. Hence the silver halide photographic materials provided have a superior light filtering effect, speed adjustment effect and increased safety under safe-lights.

Hence the compounds represented by the formula (I) are distinguished by the fact that in a multi-layer silver halide photographic material there is essentially no diffusion to other layers from the layer to which they have been added. The total number of carbon atoms in the part of the structure other than D of the compounds represented by the formulae (II), (III), (IV), (V) and (VI) is therefore at least 5, and preferably at least 10.

Furthermore, the compounds of formula (I) (as well as formulae (II) to (VI)) of this invention can be included in intermediate layers, light-sensitive emulsion layers, protective layers, overcoating layers, etc., but they are preferably present in a hydrophilic colloid layer on the opposite side of the support from the light-sensitive layer or in a hydrophilic colloid layer between the support and the light-sensitive emulsion layer.

Specifically, the compounds represented by the formulae (I), (II), (III), (IV), (V) or (VI) are preferably present in a yellow filter layer of the photographic material.

Furthermore, with the light absorbing compounds of this invention, the rate of decolorization can be controlled over a wide range by the use of nucleophilic substances such as sulfite ions, hydroxylamine, thiosulfate ions, metabisulfite ions, the hydroxamic acid and related compounds disclosed in Japanese patent application (OPI) No. 198453/84, the oxime compounds disclosed in Japanese patent application (OPI) No. 35729/85, the dihydroxybenzene based developing agents disclosed in Japanese patent application (OPI) No. 245252/87, the 1-phenyl-3-pyrazolidone based developing agents, and the p-aminophenol based developing agents as well as by means of the pH during development processing.

It is possible to speed-up the decolorization by using these nucleophilic substances and they are preferably added in amounts on the order of $10^2$ to $10^6$ times the amount of the compound of the invention (on a molar basis).

Actual examples of compounds represented by the formula (I) which are used in the invention are shown below. However the invention is not limited to just these examples.

Illustrative Compounds

-continued
Illustrative Compounds
(1)
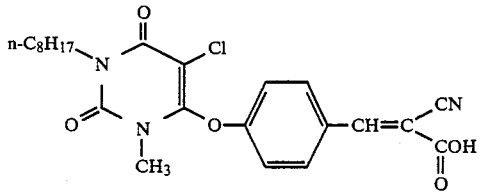
(2)
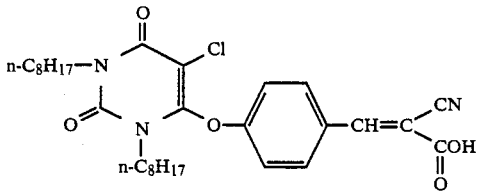
(3)
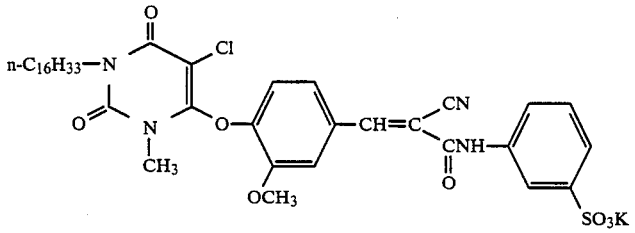
(4)
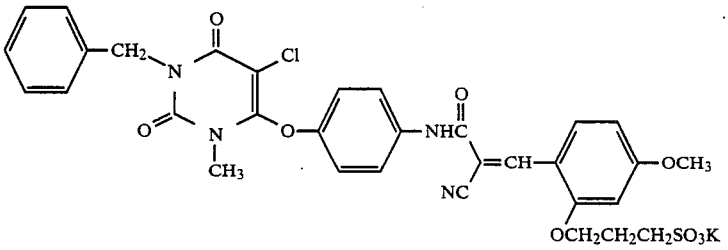
(5)
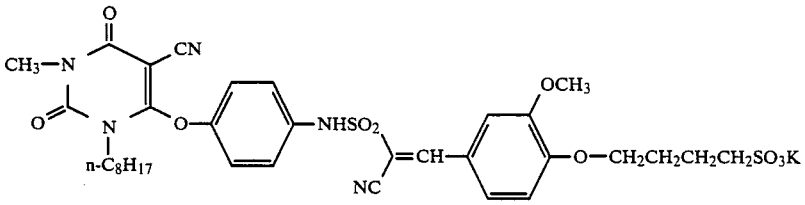
(6)
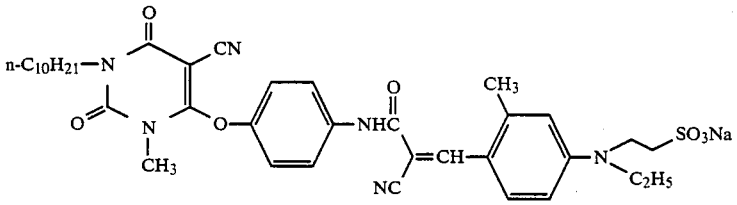
(7)
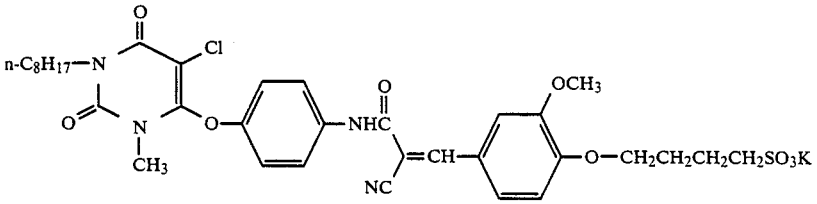

-continued
Illustrative Compounds
(8)
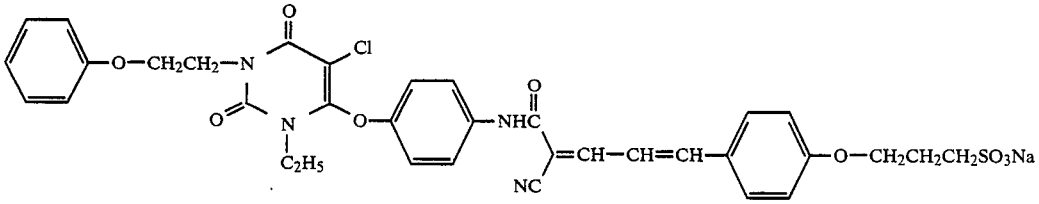
(9)
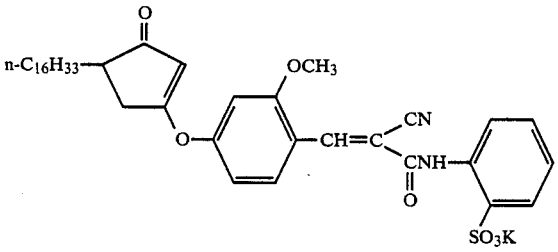
(10)
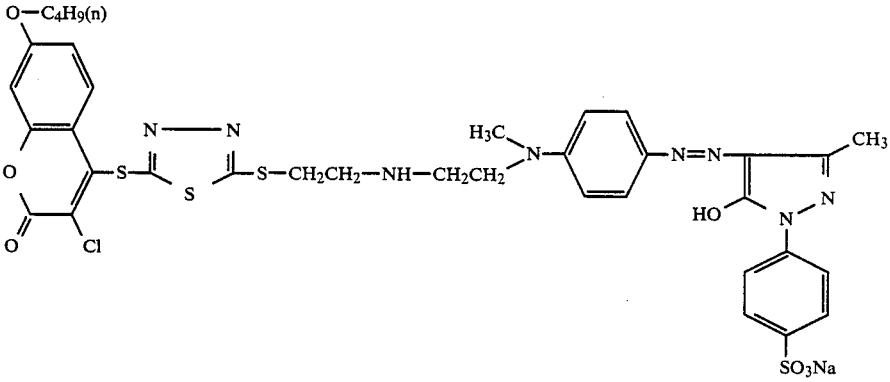
(11)
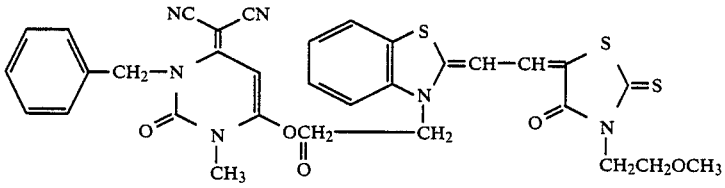
(12)
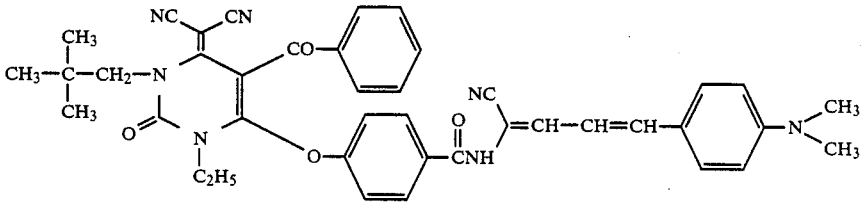
(13)
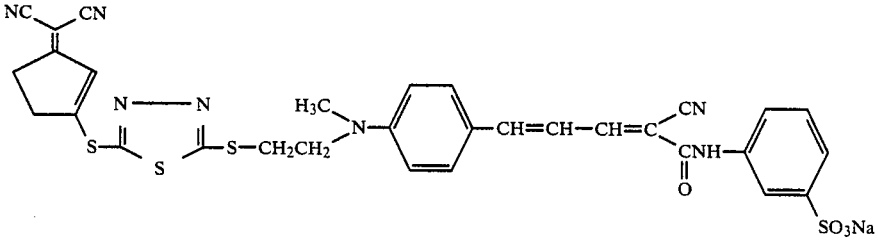

-continued
Illustrative Compounds
(14)
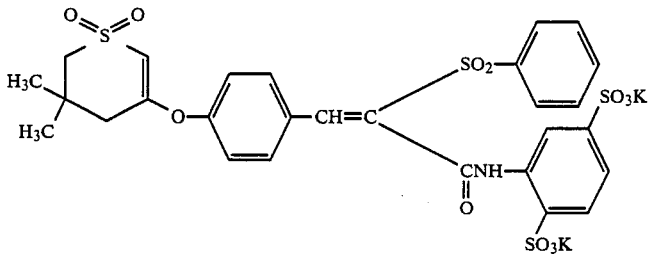
(15)
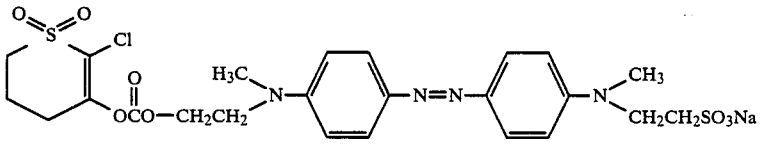
(16)
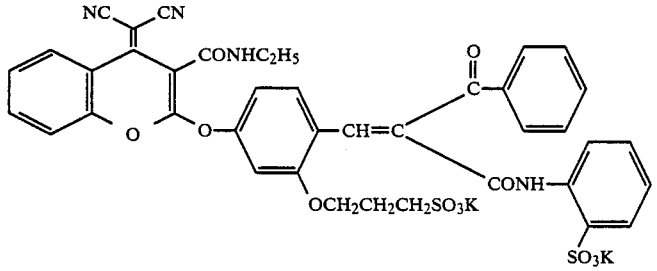
(17)
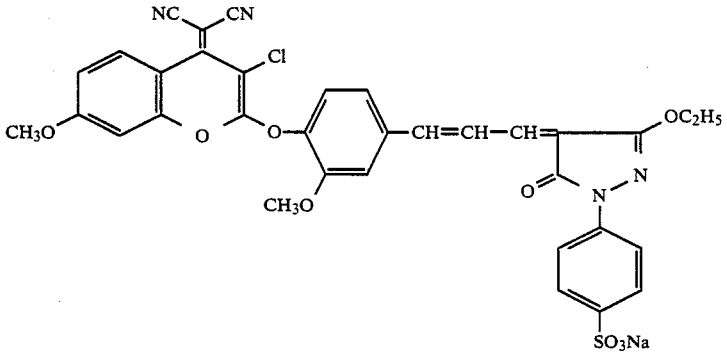
(18)
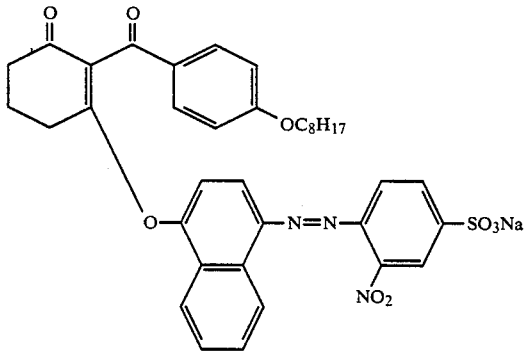
(19)
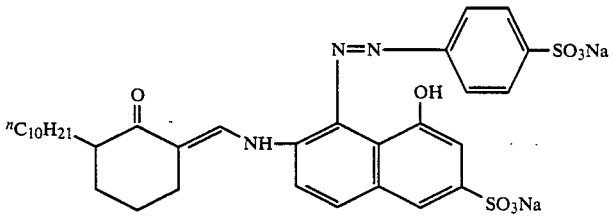

-continued
Illustrative Compounds
(20)
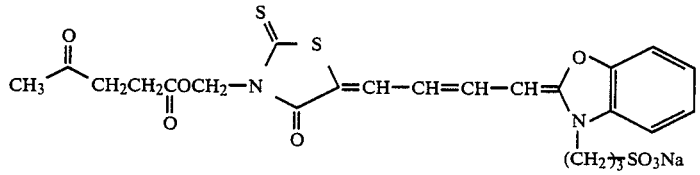
(21)
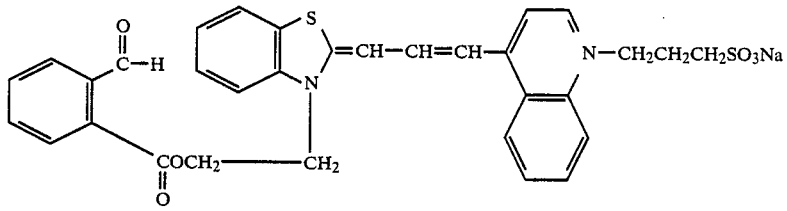
(22)
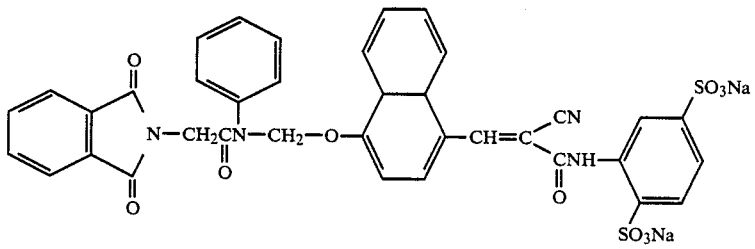
(23)
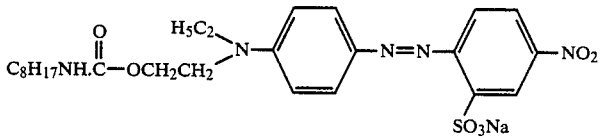
(24)
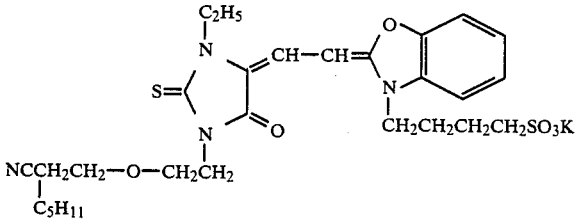
(25)
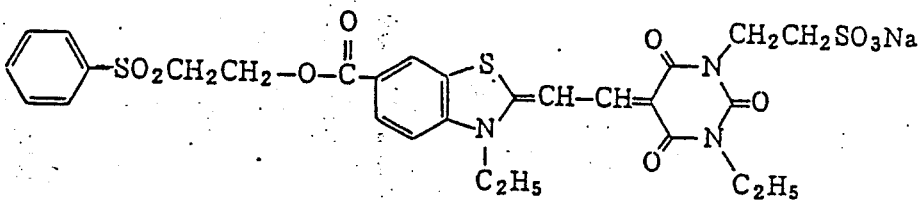
(26)
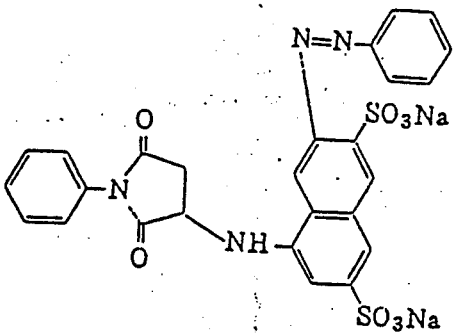

-continued
Illustrative Compounds
(27)
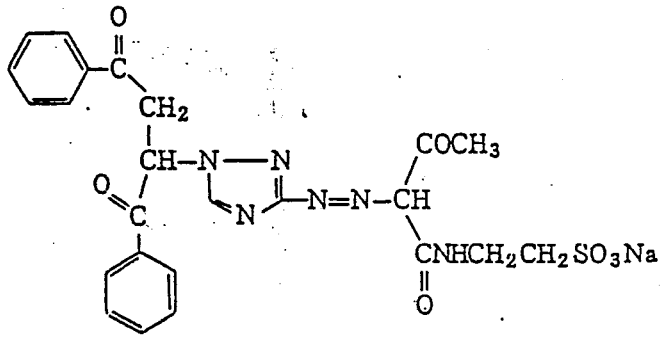
(28)
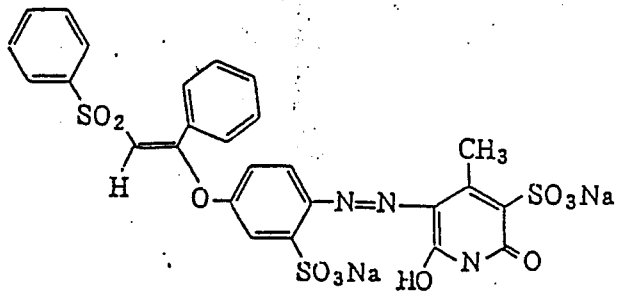
(29)
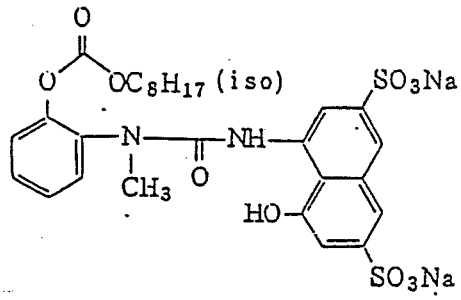
(30)
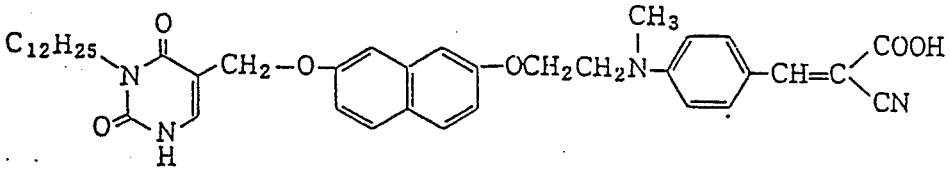
(31)
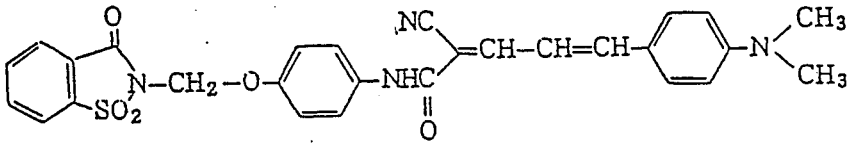

-continued
Illustrative Compounds
(32)
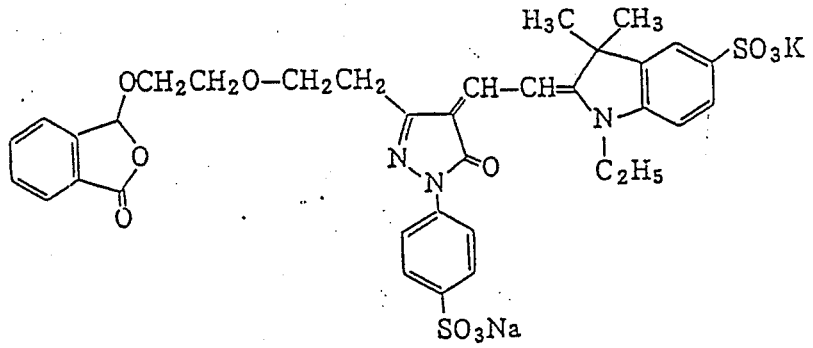
(33)
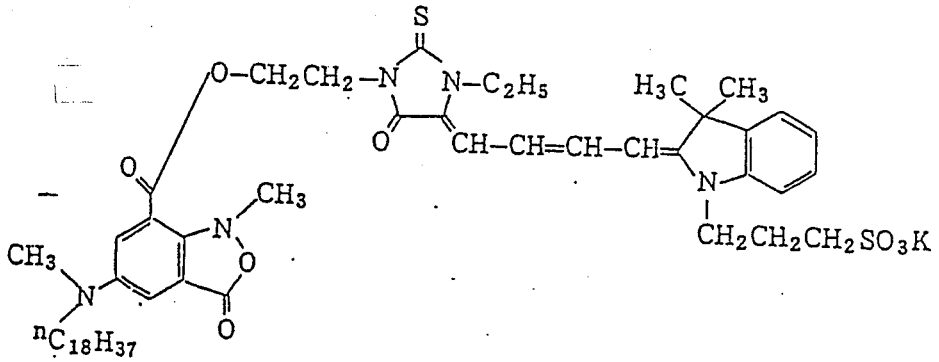
(34)
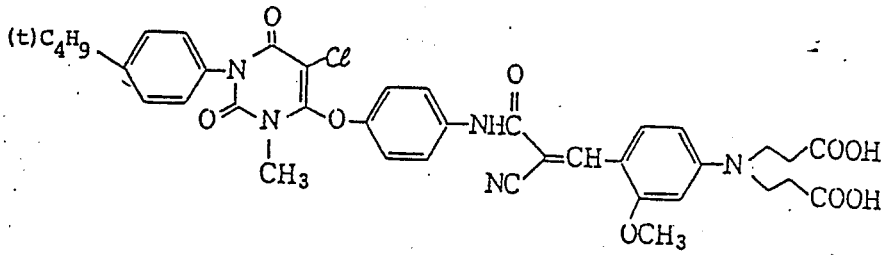
(35)
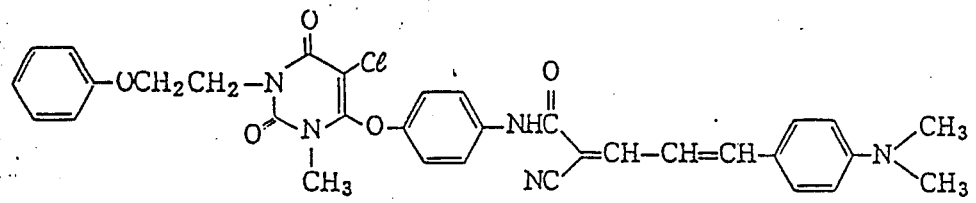

-continued

Illustrative Compounds (36)

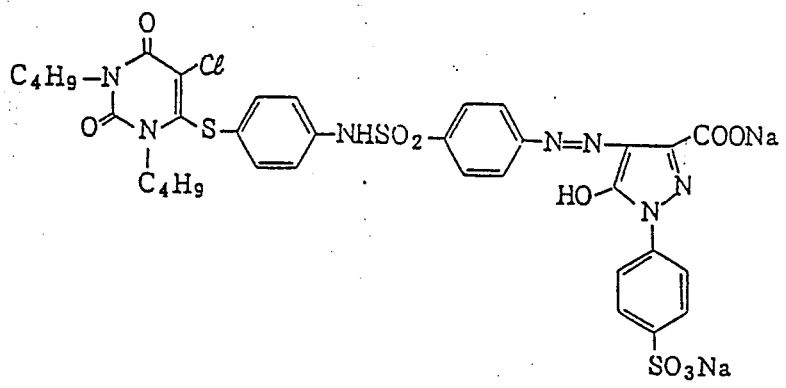

(37)

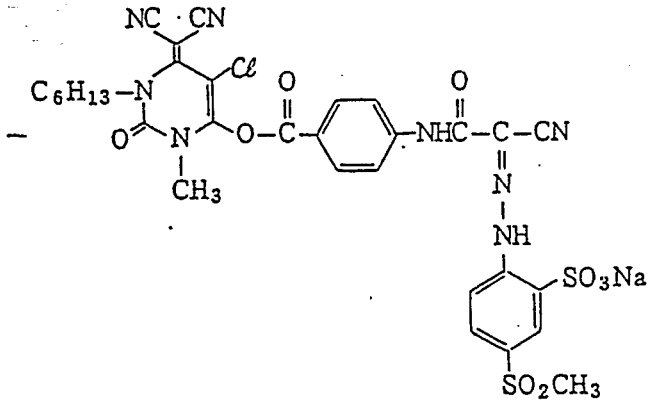

The compounds of this invention can be prepared using the methods disclosed in Japanese Pat. Publication Nos. 44805/72 (U.S. Pat. 3,615,617) and 9968/73, Japanese patent application (OPI) Nos. 8828/77 and 82834/82, Japanese Pat. Publication Nos. 17369/80 (U.S. Pat. 3,888,677), 9696/80 (U.S. Pat. 3,791,830) and 927/80 (U.S. Pat. 4,009,029), Japanese patent application (OPI) No. 77842/81 (U.S. Pat. 4,307,175), Japanese Pat. Publication No. 39727/79, Japanese patent application (OPI) Nos. 135944/82, 135945/82, 136640/82, 53330/80, 76541/82 (U.S. Pat. 4,335,200), 135949/82, 179842/82, 201057/84, 218439/84, 131945/84, 140445/84, 41034/85, 105642/84, 105640/84, 43739/86, 95347/86, 30243/87, etc.

Examples of the synthesis of typical compounds of the invention are described below.

SYNTHESIS EXAMPLE 1

Synthesis of Illustrative Compound (1)

Ten ml of an acetonitrile solution containing 2.2 grams of 1,8-diazabicyclo[5,4,0]undece-7-ene (DBU) was added to 10 ml of acetonitrile and 1.3 grams of 1-cyano-2-(4-hydroxyphenyl)ethylenecarboxylic acid and a solution was obtained. Five ml of an acetonitrile solution containing 2 grams of the 5,6-dichloro-1-methyl-3-n-octyluracil which is described hereinafter was added to this solution and the mixture was stirred at room temperature for a period of 2 hours. The reaction mixture was subsequently concentrated under reduced pressure, 50 ml of chloroform and 10 ml of 0.01N aqueous hydrochloric acid were added and the concentrate was extracted. The chloroform layer was dried over magnesium sulfate and then concentrated to dryness under reduced pressure. n-Hexane was added to the concentrate and crystals precipitated out on ice cooling. These crystals were recovered by filtration and dried, whereupon 2.3 grams of illustrative compound (1) was obtained in the form of white crystals. Melting Point 153° C.

SYNTHESIS EXAMPLE 2

Synthesis of Illustrative Compound (7)

Triethylamine (5.7 ml) was added to 5 grams of 6-chlorouracil and 20 ml of acetonitrile and a solution was formed. Next 2.2 ml of methyl iodide was added to this solution and the mixture was heated to 35° C. and stirred for a period of 2 days. The reaction mixture was then filtered and the filtrate was concentrated under reduced pressure. The concentrate was then extracted with the addition of 50 ml of chloroform and 10 ml of water and, after drying over magnesium sulfate, the chloroform layer was concentrated under reduced pressure whereupon 2.2 grams of 6-chloro-1-methyl-uracil was obtained as a light yellow colored powder.

Next 5.4 ml of n-octyl bromide was added to a solution consisting of 5 grams of 6-chloro-1-methyl-uracil obtained as described above, 5.2 grams of potassium carbonate and 50 ml of N,N-dimethylformamide and the mixture was heated to 90° C. and stirred for a period of 5 hours. After cooling, the reaction mixture was added slowly to a solution of 10 ml of concentrated hydrochloric acid and 300 ml of water. The resulting solution was extracted twice with 100 ml of chloroform and, after drying over magnesium sulfate, the chloroform layer was concentrated under reduced pressure. The concentrate was then refined using silica gel column chromatography, whereupon 3.1 grams of 6-chloro-1-methyl-3-n-octyl-uracil was obtained in the form of white crystals.

N-chlorosuccinimide (3.5 grams) was added to a solution consisting of 6 grams of 6-chloro-1-methyl-3-n-octyl-uracil obtained as described above and 15 ml of acetic acid, and the mixture was heated to 35° C. and stirred for a period of 1.5 hours. The reaction mixture was then poured into water and extracted with 100 ml of ethyl acetate. The ethyl acetate layer was washed with a saturated salt solution, dried over magnesium sulfate and then concentrated under reduced pressure. n-Hexane was added to the concentrate and the crystals which precipitated out were recovered by filtration, whereupon 6.1 grams of 5,6-dichloro-1-methyl-3-n-octyl-uracil was obtained in the form of white crystals.

Ten ml of an acetonitrile solution containing 2.9 grams of 1,8-diazabicyclo[5,4,0]undece-7-ene (DBU) was added to a solution consisting of 7.5 grams of potassium 4-(4-{2 cyano-2-(4-hydroxyphenylcarbamoyl)}ethylenyl-2-methoxy-phenoxy)butylsulfonate and 50 ml of acetonitrile and a solution was obtained. Ten ml of an acetonitrile solution of 4.8 grams of 5,6-dichloro-1-methyl-3-n-octyluracil was then added to this solution. The mixture was subsequently heated under reflux and stirred for a period of 2 hours. The crystals which separated out on leaving the mixture to cool were recovered by filtration. Illustrative compound (7) (8.1 grams) was obtained in the form of yellow crystals on recrystallizing these crystals from methanol.

(m.p. 204° C.)

SYNTHESIS EXAMPLE 3

Synthesis of Illustrative Compound (10)

Sixteen grams of aluminum chloride was added to a carbon disulfide solution of 10 grams of 3-butoxyphenol and the mixture was stirred. When the generation of hydrogen chloride had stopped, 8.5 ml of hexachloropropene was added to the mixture which was then stirred at room temperature until the generation of hydrogen chloride stopped, after which the carbon disulfide was removed by distillation under reduced pressure. Next 0.1N aqueous sulfuric acid was added to the residue, the crystals which precipitated out were recovered by filtration and, on recrystallization from diethyl ether, 4.1 grams of 7-butoxy-3,4-dichlorocoumarin (A) was obtained.

The final step is illustrated below.

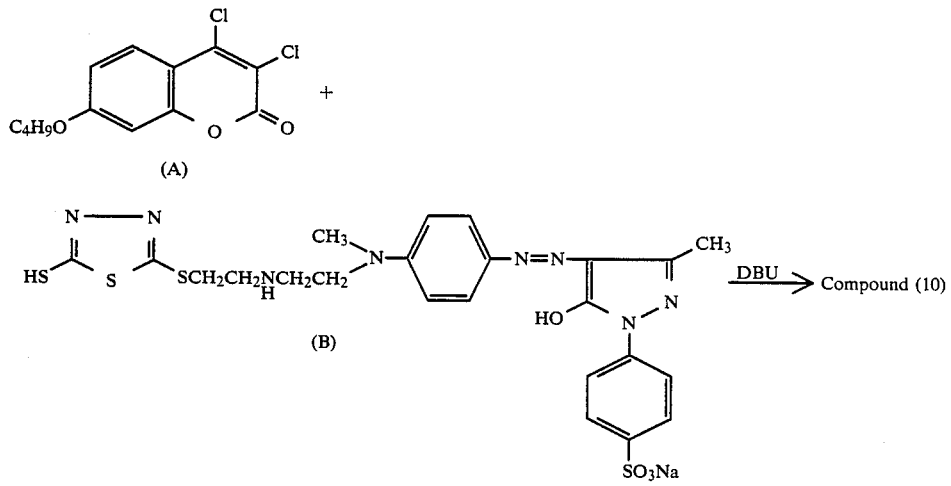

Next 1,8-diazabicyclo[5,4,0]undece-7-ene (DBU) (2.9 grams) was added to an acetonitrile solution of the azopyrazolone derivative (B) and then an acetonitrile solution of 5 grams of 7-butoxy-3,4-dichlorocoumarin (A) was added dropwise and the mixture was stirred for a period of 1 hour at room temperature. The crystals which precipitated out were recovered by filtration and recrystallized from ethanol, whereupon 5.4 grams of illustrative compound (10) was obtained. Yield 37.5%

SYNTHESIS EXAMPLE 4

Synthesis of Illustrative Compound (18)

3-Chloro-2-(4-octoxybenzoyl)cyclohexanone-2 was prepared using the method disclosed in *Chem. Pharm. Bull.* 29 (5), pp. 1312-1320 (1981).

1,8-Diazabicyclo[5,4,0]undece-7-ene (DBU) (2.2 grams) was added to an acetonitrile solution containing 5 grams of sodium 4'-(4-hydroxy-1-naphthylazo)-2'- nitrobenzenesulfonate, an acetonitrile solution containing 4.6 grams of 3-chloro-2-(4-octoxybenzoyl)cyclohexanone-2 was added dropwise and the mixture was stirred for 2 hours at room temperature. The acetonitrile was removed from the reaction mixture by distillation under reduced pressure and the residue was extracted with the addition of 100 ml of chloroform, 10 ml of water and 1 ml of hydrochloric acid. The organic layer was dried over anhydrous magnesium sulfate and concentrated under reduced pressure, and the residue was refined using silica gel column chromatography whereupon 4.3 grams of illustrative compound (18) was obtained. Yield 43.5 %

SYNTHESIS EXAMPLE 5

Synthesis of Illustrative Compound (25)

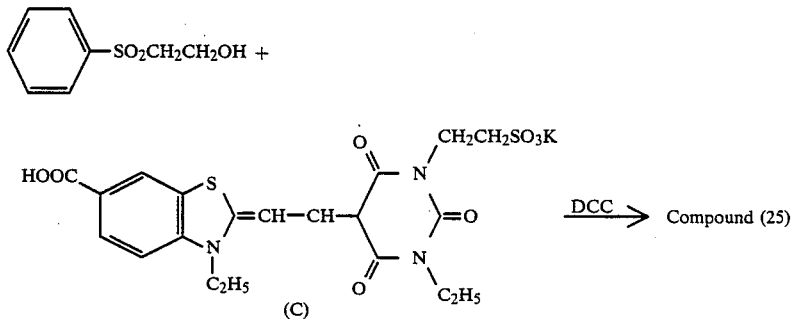

P-Toluenesulfonic acid (0.1 gram) was added to a pyridine solution of 5 grams of the merocyanine derivative (C) and 1.8 grams of 2-phenylsulfonylethanol. Next 2 ml of an N,N-dimethylformamide solution containing 2.1 grams of dicyclohexylcarbodiimide (DCC) was added dropwise and the mixture was stirred at room temperature for a period of 4 hours. The crystals (dicyclohexylurea) which precipitated out were removed by filtration and the filtrate was concentrated under reduced pressure. Acetonitrile was added to the residue and the crystals which precipitated out were recovered by filtration and recrystallized from methanol, whereupon 4.7 grams of illustrative compound (25) was obtained. Yield 71.6%

The aforementioned compounds of formula (I) which are used in the invention can be added to layers in the quantities required for the intended purpose but they are preferably used in such quantities that the optical density is within the range of from 0.05 to 3.0. The amount of the actual blocked dye used differs according to the particular dye, but in general it has been found that the use of an amount within the range from $10^{-3}$ g/m$^2$ to 3.0 g/m$^2$, and especially an amount within the rage from $10^{-3}$ g/m$^2$ to 1.0 g/m$^2$, is desirable.

The aforementioned compounds of formula (I) of this invention can be introduced into hydrophilic colloid layers using a variety of known methods.

For example, the compounds can be dissolved in an appropriate solvent [for example an alcohol (e.g., methanol, ethanol, propanol), acetone, methyl ethyl ketone, methylcellosolve, dimethylformamide, cyclohexanone, ethyl acetate] and dissolved or dispersed in gelatin, or they can be dissolved in a high boiling point oil and added in the form of an emulsified dispersion of finely divided oil droplets. The well known oils such as tricresyl phosphate, diethyl phthalate, dibutyl phthalate, triphenyl phosphate, etc. can be used for the oil.

When the layer containing the compound which can be represented by the aforementioned formula (I) of the invention is development processed, the compound is decomposed and eluted by the hydroquinone, sulfite or alkali etc. in the development bath and thus there is no coloration or staining of the photographic image.

Gelatin is the most desirable hydrophilic colloid and the various known types of gelatin can be used. For example gelatins made using different production methods such as lime treated gelatin, acid treated gelatin etc., and gelatins obtained by chemically modifying these gelatins, such as phthalated or sulfonylated gelatins, can be used. When required, a gelatin which has been subjected to a de-salting treatment can also be used.

The mixing ratio of the aforementioned compound of formula (I) of the invention with the gelatin differs according to the structure of the aforementioned compound and the amount of the compound which is added, but it has been found that a ratio within the range from $1/10^3$ to 1/3 (by weight) is preferred.

The silver halide emulsion in which the invention is used may be a silver chloride, silver bromide, silver chlorobromide, silver iodobromide or silver iodochlorobromide emulsion.

The silver halide grains in the photographic emulsion layer may have a regular crystalline form, such as a cubic form, octahedral form, tetradecahedral form, rhombic dodecahedral form, or an irregular crystalline form, such as a spherical form or plate-like form, or they may have a complex form comprised of these crystalline forms. Moreover they may consist of mixtures of grains which have a variety of crystalline forms. Furthermore the grains may have an epitaxial structure.

The silver halide grains may have different phases for the interior and the surface layers or they may consist of a uniform phase. Furthermore, they may be grains such that the latent image is formed principally on the surface of the grains (for example in a negative type emulsion) or grains such that the latent image is formed principally within the grains (for example in an internal latent image type emulsion or a pre-fogged direct reversal type emulsion).

The halide grain size is generally within the range of from 0.01 to 4.0 μm and with the light-sensitive materials for graphic arts in particular a grain size of from 0.02 to 0.4 μm is preferred, while with light-sensitive materials for general photography and X-ray film a grain size of from 0.2 to 3.0 μm is preferred.

The photographic emulsions used in the invention can be prepared using the methods disclosed in *Chimie et Physique Photographique* by P. Glafkides (published by Paul Montel, 1967), *Photographic Emulsion Chemistry* by G.F. Duffin (published by Focal Press, 1966), and

*Making and Coating Photographic Emulsion* by V.L. Zelikman (published by Focal Press, 1964), etc.

Cadmium salts, zinc salts, thallium salts, iridium salts or complex salts thereof, rhodium salts or complex salts thereof and iron salts or complex salts thereof etc. may be present during the formation or physical ripening of the silver halide grains.

The silver halide emulsion may or may not be chemically sensitized. The methods disclosed on pages 675 to 734 of *Die Grundlagen der Photographischen Prozesse mit Silberhalogeniden,* by H. Frieser (Akademische Verlagsgeschelshaft, 1968) for example can be used for chemical sensitization.

That is to say, sulfur sensitizing methods in which compounds which contain sulfur in a form which can react with active gelatin and silver (for example, thiosulfate, thioureas, mercapto compounds, rhodanines, etc.) are used; reduction sensitizing methods in which reducing substances (for example, stannous salts, amines, hydrazine derivatives, formamidine sulfinic acid, silane compounds) are used; and noble metal sensitizing methods in which noble metal compounds (not only gold complex salts but also complex salts of metals of groups VIII of the periodic table such as Pt, Ir, Pd, etc.) are used; can be used individually or conjointly.

Various compounds can be included in the photographic emulsion used in the invention with a view to preventing the occurrence of fogging during the manufacture, storage or photographic processing of the photographic material or for the stabilization of photographic performance. That is to say a large number of compounds which are known as anti-fogging agents or stabilizers, such as azoles, for example benzothiazolium salts, nitroindazoles, triazoles, benzotriazoles, benzimidazoles (especially benzimidazoles substituted with a nitro group or halogen atom); heterocyclic mercapto compounds, for example mercaptothiazoles, mercaptobenzothiazoles, mercaptobenzimidazoles, mercaptothiadiazoles, mercaptotetrazoles (especially 1-phenyl-5-mercaptotetrazoles), mercaptopyrimidines; the above mentioned heterocyclic mercapto compounds which have water-soluble groups such as carboxyl groups or sulfo groups; thioketo compounds, for example oxazolinthione; azaindenes, for example tetraazaindenes (especially 4-hydroxy substituted 1,3,3a,7-tetraazaindenes); benzenethiosulfonic acids; benzenesulfinic acids; etc. can be added.

The silver halide photographic emulsions of this invention may also contain color couplers such as cyan couplers, magenta couplers, yellow couplers etc. and compounds in which couplers are dispersed.

That is to say, compounds which can form a color by oxidative coupling with a primary aromatic amine color developing agent (for example, a phenylenediamine derivative, aminophenol derivative, etc.) in the color development process may be included. For example there are the 5-pyrazolone couplers, pyrazolobenzimidazole couplers, cyanoacetylcoumarone couplers and open chain acylacetonitrile couplers as magenta couplers; the acylacetamide couplers (for example, the benzoylacetanilides, pivaloylacetanilides, etc.) as yellow couplers; and the naphthol couplers and phenol couplers etc. as cyan couplers.

These couplers are preferably fast to diffusion, having hydrophobic groups known as ballast groups within the molecule. The coupler may be either four equivalent or two equivalent with respect to silver ion. There are also colored couplers which have a color compensating effect and couplers (known as DIR couplers) which release development inhibitors as development proceeds.

Furthermore, colorless DIR coupling compounds of which the products of the coupling reaction are colorless and which release a development inhibitor may be included as well as these DIR couplers.

Moreover, polyalkyleneoxides or ether, ester, amine etc. derivatives, thioether compounds, thiomorpholines, quaternary ammonium salt compounds, urethane derivatives, urea derivatives, imidazole derivatives, 3-pyrazolidone derivatives, etc., may be included in the photographic emulsions of this invention with a view to raising sensitivity, raising contrast or accelerating development.

Known water soluble dyes other than dyes disclosed in the invention (for example, oxonol dyes, hemioxonol dyes and merocyanine dyes) can be used in combination as filter dyes, for the prevention of irradiation or for various other purposes in the silver halide photographic emulsions of this invention. Furthermore, as well as the dyes disclosed in the invention the known cyanine dyes, merocyanine dyes and hemicyanine dyes can also be used conjointly as spectral sensitizing agents.

Various surfactants may also be included in the photographic emulsions of this invention as coating aids and anti-static agents, for improving sliding properties, for dispersion and emulsification purposes, for the prevention of sticking, and for improving photographic performance (for example for accelerating development, increasing contrast and sensitization) etc.

Furthermore, actual disclosures are made in *Research Disclosure,* Vol. 17, 6 (December, 1978), RD 17643 etc. in connection with discoloration inhibitors, hardening agents, anti-color fogging agents, ultraviolet absorbers, protective colloids such as gelatin etc., and various other additives which can be used in the photographic materials of this invention.

Furthermore, hydrazine derivatives such as those disclosed in U.S. Pat. 4,224,401, 4,168,977, 4,166,742, 4,311,781, 4,272,606, 4,211,857 and 4,243,739 can be included in the case of superhigh contrast negative light-sensitive materials for use in the graphic arts.

The preferred hydrazine derivatives for use in the invention can be represented by the formula (VII) below.

$$A'-\underset{\underset{X'}{|}}{N}-\underset{\underset{Y'}{|}}{N}-F' \qquad \text{(VIII)}$$

wherein A' represents an aliphatic group or an aromatic group, F' represents a formyl group, an acyl group, an alkyl or aryl sulfonyl group, an alkyl or aryl sulfinyl group, a carbamoyl group, an alkoxy or aryloxy carbonyl group, a sulfinamoyl group, an alkoxysulfonyl group, a thioacyl group, a thiocarbamoyl group, a sulfamoyl group, or a heterocyclic group, and X' and Y' both represent hydrogen atoms of one of them represents a hydrogen atom and the other represents a substituted or unsubstituted alkylsulfonyl group, a substituted or unsubstituted arylsulfonyl group, or a substituted or unsubstituted acyl group.

Moreover F', Y' and the nitrogen atoms which join them together may form the

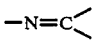
structural part of a hydrazone.
Actual examples of compounds which can be represented by formula (VII) are indicated below. However, the invention is not limited to these compounds.
(VII-1)
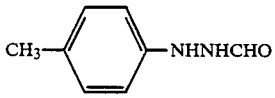
(VII-2)
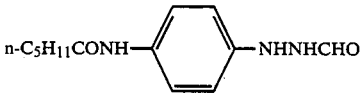
(VII-3)
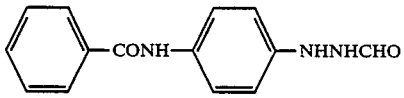
(VII-4)
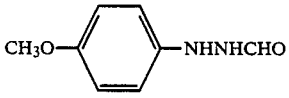
(VII-5)
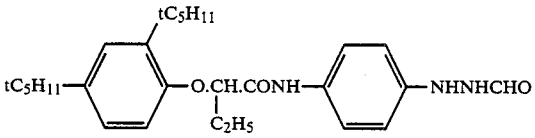
(VII-6)
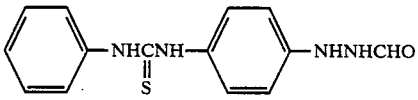
(VII-7)
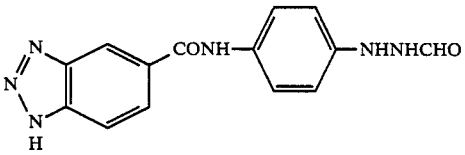
(VII-8)
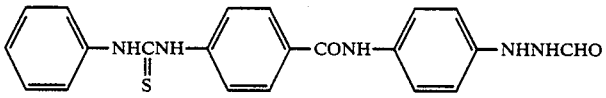
(VII-9)
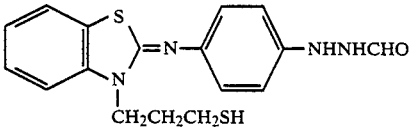
(VII-10)
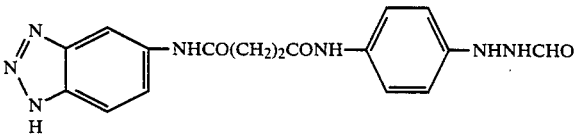
(VII-11)
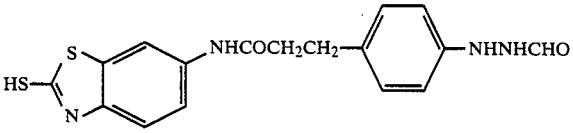

-continued
(VII-12)
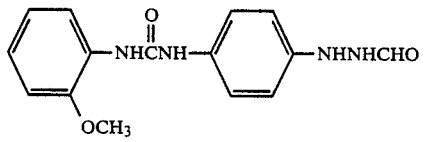
(VII-13)
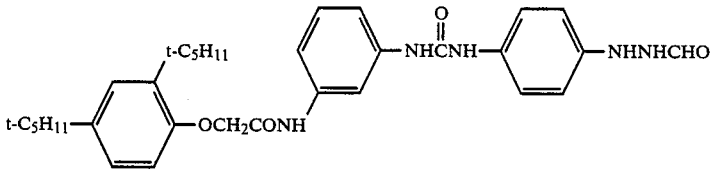
(VII-14)
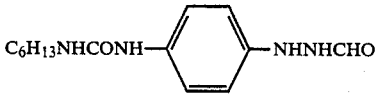
(VII-15)
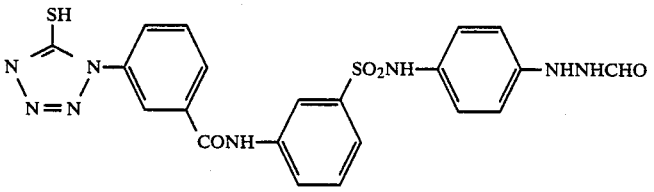
(VII-16)
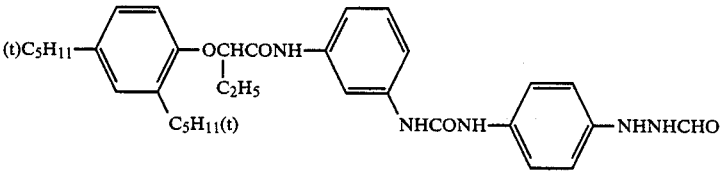
(VII-17)
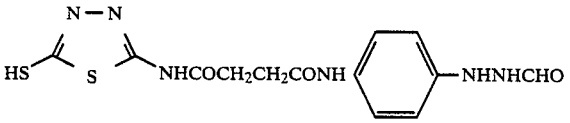
(VII-18)
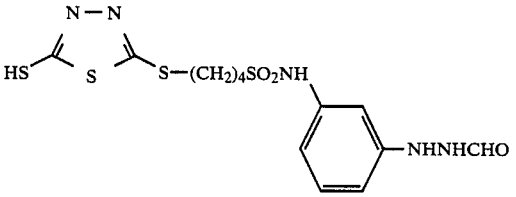
(VII-19)
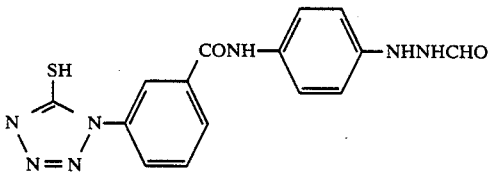
(VII-20)
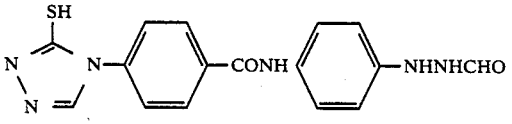
(VII-21)
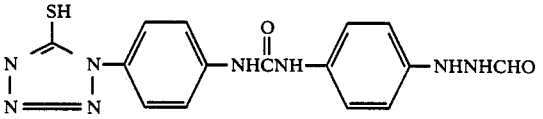

-continued (VII-22)

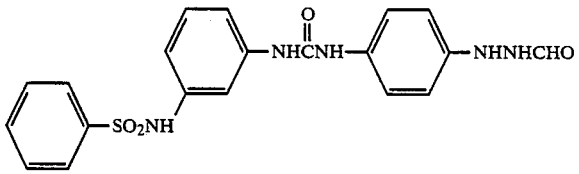

(VII-23)

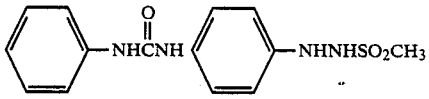

(VII-24)

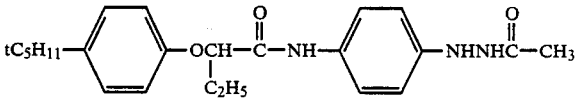

(VII-25)

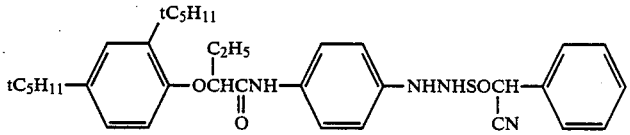

The compounds represented by the formula (VII) are preferably included in an amount of from $1\times10^{-6}$ mol to $5\times10^{-2}$ mol, per mol of silver halide, and the inclusion of an amount of from $1\times10^{-5}$ mol to $2\times10^{-2}$ mol, per mol of silver halide is especially desirable.

Furthermore, organic desensitizers may be included in graphic arts photographic materials, especially those photographic materials for bright room use. The most desirable organic desensitizers have at least one water-soluble group or alkali-dissociable group.

Actual examples have been disclosed in Japanese patent application No. 209169/86 (U.S. patent application Ser. No. 07/093.341).

Furthermore, the use of the compounds indicated as development accelerators in Japanese patent application (OPI) Nos. 77616/78, 37732/79, 137133/78, 140340/85 and 14959/85 and in Japanese patent application No. 205603/86 is preferred in the case of photographic materials of this type in which hydrazine derivatives have been used.

The finished emulsion is coated onto an appropriate support, such as baryta paper, resin coated paper, synthetic paper, triacetate film, polyethyleneterephthalate film, other plastic bases, or glass plates.

The silver halide photographic materials of this invention may be for example color positive films, color papers, color negative films, color reversal films (both those which have incorporated couplers and those which do not), photographic materials for photomechanical processes (for example, lith films, lith dupe films, etc.), photosensitive materials for cathode ray tube display purposes (for example, photosensitive emulsions for X-ray recording and materials for obtaining pictures either directly or indirectly using a screen), photosensitive materials for silver salt diffusion transfer process purposes, photosensitive materials for color diffusion transfer process purposes, emulsions in which the silver dye bleach method is used and photosensitive materials for thermal development purposes (more precisely those disclosed in U.S. Pat. 4,500,626, Japanese patent application (OPI) Nos. 133449/85, 218443/84 and 238056/86), etc.

The exposure for obtaining the photographic image can be made using the normal methods. Thus a variety of known light sources such as natural light (sunlight), tungsten lamps, fluorescent lamps, mercury lamps, xenon arc lamps, carbon arc lamps, xenon flash lamps and the flying spot of a cathode ray tube, etc. can be used for this purpose. The exposure time may of course be from one thousandth of a second to one second as used in a normal camera, or it may be shorter than one thousandth of a second, for example from one ten thousandth of a second to one millionth of a second in cases where a xenon strobe light or a cathode ray tube is used, or it may be longer than one second. The spectral composition of the light used for the exposure can be adjusted, as required, using color filters. Laser beams can be employed for exposure. Moreover exposures can also be made using the light emitted from phosphors which have been excited by an electron beam, X-rays, $\gamma$-rays, $\alpha$-rays, etc.

All of the known methods and known processing baths such as those disclosed in *Research Disclosure,* No. 176, page 28 to 30 (RD-17643) for example can be used for the photographic processing of the photographic materials obtained using the method of this invention.

This photographic processing may take the form of photographic processing in which a silver image is formed (black and white photographic processing) or photographic processing in which a dye image is formed (color photographic processing) as required. The pH of the development bath is different in black and white development baths and color development baths and depends on the type of developing agent being used and upon the type of photographic material being processed and there are no general limits, but in most cases the pH is normally within the range from 9 to 12.5. A processing temperature can normally be selected between 18° C and 50° C but temperatures below 18° C. and in excess of 50° C. can be used.

The invention is described in detail below on the basis of examples.

Unless otherwise specified, all parts, percents, ratios etc. are by weight.

EXAMPLE 1

(Preparation of Emulsion A)

An aqueous silver nitrate solution and an aqueous sodium chloride solution which contained $1.0\times10^{-4}$ mol of ammonium hexachlororhodinate per mol of silver were mixed using the double jet method in a gelatin solution at 35° C. while controlling the pH at 2.3, and a mono-dispersed silver halide emulsion of average grain size 0.1 micron was obtained.

After forming the grains, the soluble salts were removed using the flocculation method well known in the industry and 4-hydroxy-6-methyl-1,3,3a,7-tetraazaindene and 1-phenyl-5-mercaptotetrazole were added as stabilizers.

One kilogram of this emulsion contained 55 grams of gelatin and 105 grams of silver. (Emulsion A). (Preparation of the Light-Sensitive Material)

The nucleating agent of which the formula is indicated below and the organic desensitizer of which the formula is indicated below were added to the aforementioned emulsion A in amounts of 9 mg per gram of silver and 2 mg per gram of silver, respectively.

Nucleating Agent

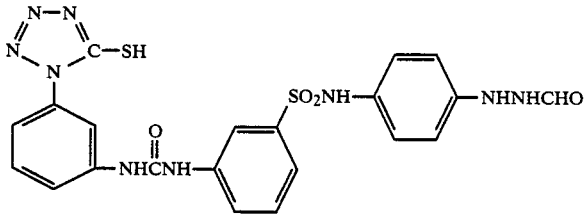

Organic Desensitizer

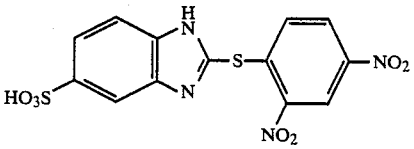

Finally, 2,4-dichloro-6-hydroxy-1,3,5-triazine, sodium salt was added as a hardening agent and a silver halide emulsion layer was coated on a transparent polyethyleneterephthalate support in such a way that the coated weight of silver was 3.5 grams per square meter. A protective layer which contained gelatin (1.3 g/m$^2$) and Compound (1) of this invention (0.1 g/m$^2$) was coated over the top of the aforementioned layer and dried. (Sample 1).

In the case of Compound (1) the gelatin dispersion was prepared and coated using the following procedure: A solution obtained by dissolving 4.9 grams of Compound (1) in an equimolar quantity of NaOH (1N) and 39 ml of methyl ethyl ketone was mixed with stirring at 45° C. with 260 grams of a 5.0% (by weight) aqueous gelatin solution and an emulsified dispersion was obtained.

COMPARATIVE EXAMPLE 1

(1) A sample was prepared as in Example 1 but without including Compound (1). (Sample A).

(2) Comparative sample B was prepared in the same way except that the water-soluble ultraviolet absorbing dye shown below (0.05 g/m$^2$) was used in place of Compound (1) in Example 1.

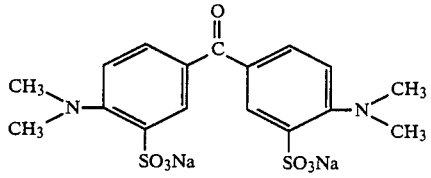

(Evaluation of Performance)

(1) The three samples described above were exposed through an optical wedge using a printer for bright room, P-607 made by the Dainippon Screen Mfg. Co., Ltd. developed for 20 seconds at 38° C. in the development bath indicated below and then fixed, washed and dried in the usual way. With sample B and sample 1 the UV optical density of the highlights was low as with of sample A and complete decolorization had occurred.

Development Bath Basic Formulation

| | |
|---|---|
| Hydroquinone | 35.0 grams |
| N-Methyl-p-aminophenol semisulfate | 0.8 gram |
| Sodium hydroxide | 13.0 grams |
| 5-Sulfosalicylic acid | 74.0 grams |
| Potassium sulfite | 90.0 grams |
| Ethylenediamine tetra-acetic acid tetra-sodium salt | 1.0 gram |
| Potassium bromide | 4.0 grams |
| 5-Methylbenzotriazole | 0.6 gram |
| 3-Diethylamino-1,2-propandiol | 15.0 grams |
| Water | to make up to 1 liter (pH = 11.5) |

The speed, in terms of the log E value, was 0.4 lower with comparative sample B and 0.5 lower with sample 1 when compared to that of comparative sample A. From a practical point of view, the speeds of sample B and sample 1 were in the proper range.

(2) Safe-lighting Safety Test

The three samples described above were tested for safe time under a 400 lux UV-cut fluorescent lamp safe light (FLR-40, SW-DLX-NU/M made by Toshiba Corporation). While comparative sample A was safe for 10 minutes, comparative sample B was safe for 25 minutes and sample 1 of this invention was safe for 32 minutes.

It is clear from the test results in (1) and (2) above that Compound (1) of this invention is more effective for reducing the speed to the proper range and also provides greater safety under safe lighting.

(3) Tonal Variability Test

The three samples described above were tested through a flat mesh screen using the printer mentioned above and then developed and processed in the same way as in test (1). With all of these samples, the exposure time taken to return the dot area to 1:1 was determined and then the samples were exposed for double and four times this exposure time and the way in which the dot area had extended was investigated. The greater the extension the better the tonal variability. The results obtained were as shown in Table 1. It is clear from these results that comparative sample B had a markedly reduced tonal variability while sample 1 of this invention had high tonal variability. This is because the dye used in comparative sample B is water-soluble and diffusible so that it can diffuse uniformly from the layer to which it has been added into the light-sensitive emulsion layer so that when the exposure time is increased, the enlargement of the dot area is inhibited by the anti-irradiation effect due to this dye. On the other hand, Compound (1) of this invention is fixed in the layer to which it has been added and so the material containing this compound exhibits a high tonal variability.

TABLE 1

| Tonal Variability (Indicated by the Extent of the Increase in Dot Area) | | |
|---|---|---|
| | Double Exposure | Quadruple Exposure |
| Comparative Sample A | +5% | +9% |
| Comparative Sample B | +2% | +4% |
| Sample 1 of this Invention | +5% | +9% |

(4) Evaluation of Staining by Reducing Baths

A strip of sample 1 of this invention obtained by processing as described in (3) above was immersed for 60 seconds at 20° C. in the Farmer's reducing bath indicated below and then it was washed and dried. As a result the regions of dot area of 50% were reduced to 33% and there was no sign of staining.

| Farmer's Reducing Bath | | |
|---|---|---|
| Solution 1: | Water | 200 ml |
| | Sodium thiosulfate | 20 grams |
| Solution 2 | Water | 100 ml |
| | Potassium ferricyanide | 10 grams |

Mixed for use in the ratio Solution 1:Solution 2:water = 100 parts:5 parts:100 parts.

EXAMPLE 2

Samples 2a, 2b, 2c, 2d and 2e were prepared using Compounds (3), (7), (13), (18) and (20) in place of Compound (1) in Example 1 and these samples were evaluated in the same was as in Example 1.

The results obtained were effectively the same as those for sample 1 in Example 1 in that the speed was reduced to the proper range, the safe-lighting safety was increased and they exhibited better tonal variability. Moreover no staining was observed following reducing treatment.

EXAMPLE 3

Compound (1) was dissolved using the oil and auxiliary solvents indicated below and an emulsified dispersion in gelatin was prepared using a homogenizer. After emulsification and dispersion the material was formed into a noodle form and washed with water, and finally water was added to make up to a weight of 300 grams.

| | |
|---|---|
| Gelatin (10 wt % aqueous solution) | 100 grams |
| Sodium nonylphenylsulfonate | 0.5 gram |
| Compound (1) | 5.8 grams |
| Tricresyl phosphate | 5.8 grams |
| Cyclohexanone | 26 ml |
| Ethyl acetate | 26 ml |
| Water | to make up to 300 grams |

A sample was prepared in the same way as in Example 1 except that the emulsified dispersion obtained in this way was used in place of the Compound (1) in Example 1.

The results obtained were good, as in the case of sample 1.

EXAMPLE 4

The multi-layer color photographic material (Sample 41) was prepared by multi-layer coating layers of which the compositions are shown below on an undercoated cellulose triacetate film.

[Compositions of the Light-Sensitive Layers]

The numerical values given for each component indicate the amount coated expressed in units of g/m$^2$, and in the case of the silver halides this indicates the amount coated calculated as silver. However in the case of the sensitizing dyes the amount coated is indicated in units of mol per mol of silver halide in the same layer.

| | |
|---|---|
| First Layer (Anti-halation Layer) | |
| Black colloidal silver | 0.2 |
| Gelatin | 1.4 |
| UV-1 | 0.02 |
| UV-2 | 0.04 |
| UV-3 | 0.04 |
| Solv-1 | 0.05 |
| Second Layer (Intermediate Layer) | |
| Fine grained silver bromide (average grain size 0.07 μm) | 0.08 |
| Gelatin | 1.1 |
| ExC-1 | 0.02 |
| ExM-1 | 0.06 |
| UV-1 | 0.03 |
| UV-2 | 0.06 |
| UV-3 | 0.07 |
| Cpd-1 | 0.1 |
| ExF-1 | 0.004 |
| Solv-1 | 0.1 |
| Solv-2 | 0.09 |
| Third Layer (Low Speed Red Sensitive Emulsion Layer) | |
| Silver iodobromide emulsion (6.3 mol % AgI, high internal AgI type, core/shell (c/s) ratio 1/1, equivalent sphere diameter 0.8 μm, variation coefficient of the equivalent sphere diameter 25%, plate-like grains, diameter/thickness ratio 2) | 1.5 (as Ag) |
| Gelatin | 1.7 |
| ExC-2 | 0.3 |
| ExC-3 | 0.02 |
| ExS-1 | $7.1 \times 10^{-5}$ |
| ExS-2 | $1.9 \times 10^{-5}$ |

-continued

| | |
|---|---|
| ExS-3 | $2.4 \times 10^{-4}$ |
| ExS-4 | $4.2 \times 10^{-5}$ |
| Solv-2 | 0.03 |
| Fourth Layer (Intermediate Speed Red Sensitive Emulsion Layer) | |
| Silver iodobromide emulsion (4.8 mol % AgI, high internal AgI type, c/s ratio ¼, equivalent sphere diameter 0.9 μm, variation coefficient of the equivalent sphere diameter 50%, plate-like grains, diameter/thickness ratio 1.5) | 1.4 (as Ag) |
| Gelatin | 2.1 |
| ExC-2 | 0.4 |
| ExC-3 | 0.002 |
| ExS-1 | $5.2 \times 10^{-5}$ |
| ExS-2 | $1.4 \times 10^{-5}$ |
| ExS-3 | $1.8 \times 10^{-4}$ |
| ExS-4 | $3.1 \times 10^{-5}$ |
| Solv-2 | 0.5 |
| Fifth Layer (High Speed Red Sensitive Emulsion Layer) | |
| Silver iodobromide emulsion (10.2 mol % AgI, high internal AgI type, c/s ratio ½, equivalent sphere diameter 1.2 μm, variation coefficient of the equivalent sphere diameter 35%, plate-like grains, diameter/thickness ratio 3.5) | 2.1 (as Ag) |
| Gelatin | 2.0 |
| ExC-1 | 0.06 |
| ExC-4 | 0.04 |
| ExC-5 | 0.2 |
| ExS-1 | $6.5 \times 10^{-5}$ |
| ExS-2 | $1.7 \times 10^{-5}$ |
| ExS-3 | $2.2 \times 10^{-4}$ |
| ExS-4 | $3.8 \times 10^{-5}$ |
| Solv-1 | 0.1 |
| Solv-2 | 0.3 |
| Sixth Layer (Intermediate Layer) | |
| Gelatin | 1.1 |
| Seventh Layer (Low Speed Green Sensitive Emulsion Layer | |
| Silver iodobromide emulsion (6.3 mol % AgI, high internal AgI type, c/s ratio 1/1, equivalent sphere diameter 0.8 μm, variation coefficient of the equivalent sphere diameter 25%, plate-like grains, diameter/thickness ratio 2) | 0.6 (as Ag) |
| Gelatin | 0.8 |
| ExM-2 | 0.3 |
| ExM-1 | 0.03 |
| ExM-3 | 0.05 |
| ExY-1 | 0.04 |
| ExS-5 | $3.1 \times 10^{-5}$ |
| ExS-6 | $1.0 \times 10^{-4}$ |
| ExS-7 | $3.8 \times 10^{-4}$ |
| H-1 | 0.04 |
| H-2 | 0.01 |
| Solv-2 | 0.2 |
| Eighth Layer (Intermediate Speed Green Sensitive Emulsion Layer) | |
| Silver iodobromide emulsion (4.8 mol % AgI, high internal AgI type, c/s ratio ¼, equivalent sphere diameter 0.9 μm, variation coefficient of the equivalent sphere diameter 50%, plate-like grains, diameter/thickness ratio 1.5) | 1.1 (as Ag) |
| Gelatin | 1.4 |
| ExM-4 | 0.2 |
| ExM-5 | 0.05 |
| ExM-1 | 0.01 |
| ExM-3 | 0.01 |
| ExY-1 | 0.02 |
| ExS-5 | $2.0 \times 10^{-5}$ |
| ExS-6 | $7.0 \times 10^{-5}$ |
| ExS-7 | $2.6 \times 10^{-4}$ |
| H-1 | 0.07 |
| H-2 | 0.02 |
| Solv-1 | 0.06 |

-continued

| | |
|---|---|
| Solv-2 | 0.4 |
| Ninth Layer (High Speed Green Sensitive Emulsion Layer) | |
| Silver iodobromide emulsion (10.2 mol % AgI, high internal AgI type, c/s ratio ½, equivalent sphere diameter 1.2 μm, variation coefficient of the equivalent sphere diameter 38%, plate-like grains, diameter/thickness ratio 4) | 2.1 (as Ag) |
| Gelatin | 2.2 |
| ExC-2 | 0.02 |
| ExM-5 | 0.1 |
| ExM-1 | 0.05 |
| ExS-5 | $3.5 \times 10^{-5}$ |
| ExS-6 | $8.0 \times 10^{-5}$ |
| ExS-7 | $3.0 \times 10^{-4}$ |
| Solv-1 | 0.08 |
| Solv-2 | 0.7 |
| Tenth Layer (Yellow Filter Layer | |
| Yellow colloidal silver | 0.08 |
| Gelatin | 1.0 |
| Cpd-1 | 0.1 |
| Eleventh Layer (Low Speed Blue Sensitive Emulsion Layer) | |
| Silver iodobromide emulsion (9.0 mol % AgI, high internal AgI type, c/s ratio ½, equivalent sphere diameter 0.75 μm, variation coefficient of the equivalent sphere diameter 21%, plate-like grains, diameter/thickness ratio 1) | 0.3 (as Ag) |
| Gelatin | 1.3 |
| ExY-2 | 0.7 |
| ExY-1 | 0.03 |
| H-1 | 0.03 |
| H-2 | 0.01 |
| Solv-2 | 0.3 |
| Twelfth Layer (Intermediate Speed Blue Sensitive Emulsion Layer) | |
| Silver iodobromide emulsion (10.2 mol % AgI, high internal AgI type, c/s ratio ½, equivalent sphere diameter 1.0 μm, variation coefficient of the equivalent sphere diameter 30%, plate-like grains, diameter/thickness ratio 3.5) | 0.4 (as Ag) |
| Gelatin | 0.7 |
| ExY-2 | 0.1 |
| ExS-8 | $2.2 \times 10^{-4}$ |
| H-1 | 0.01 |
| H-2 | 0.005 |
| Solv-2 | 0.05 |
| Thirteenth Layer (High Speed Blue Sensitive Emulsion Layer) | |
| Silver iodobromide emulsion (9.8 mol % AgI, high internal AgI type, c/s ratio ½, equivalent sphere diameter 1.8 μm, variation coefficient of the equivalent sphere diameter 55%, plate-like grains, diameter/thickness ratio 6.5) | 0.8 (as Ag) |
| Gelatin | 0.7 |
| ExY-2 | 0.2 |
| ExS-8 | $2.3 \times 10^{-4}$ |
| Solv-2 | 0.07 |
| Fourteenth Layer (First Protective Layer) | |
| Gelatin | 0.9 |
| UV-4 | 0.1 |
| UV-5 | 0.2 |
| H-1 | 0.02 |
| H-2 | 0.005 |
| Solv-3 | 0.03 |
| Cpd-2 | 0.7 |
| Fifteenth Layer (Second Protective Layer) | |
| Fine grained silver bromide emulsion (average grain diameter 0.07 μm) | 0.1 |
| Gelatin | 0.7 |
| H-1 | 0.2 |
| H-2 | 0.05 |

ExS-1
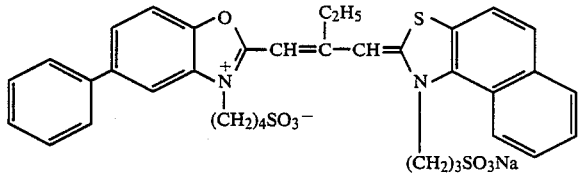
ExS-2
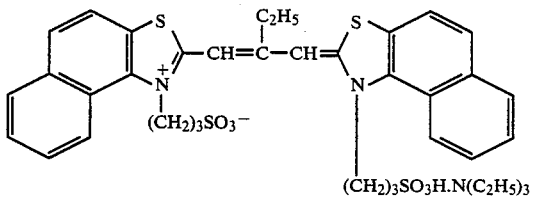
ExS-3
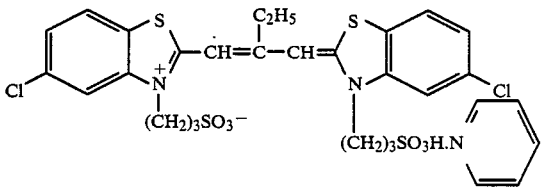
ExS-4
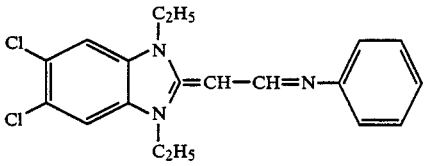
ExS-5
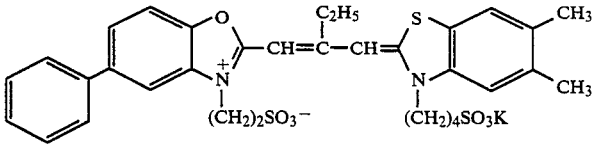
ExS-6
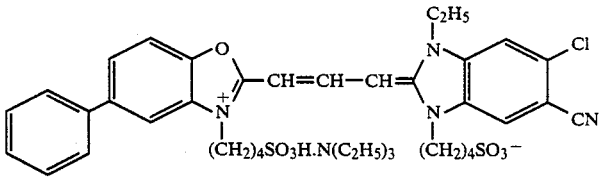
ExS-7
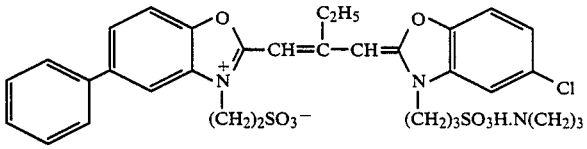
ExS-8
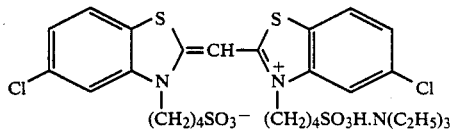

-continued
ExC-1
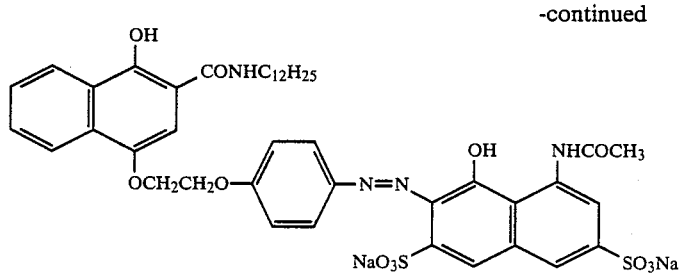
ExC-2
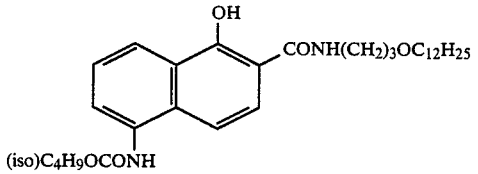
ExC-3
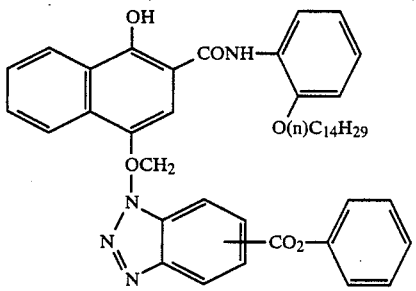
ExC-4
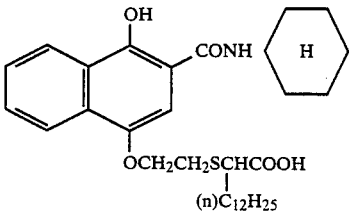
ExC-5
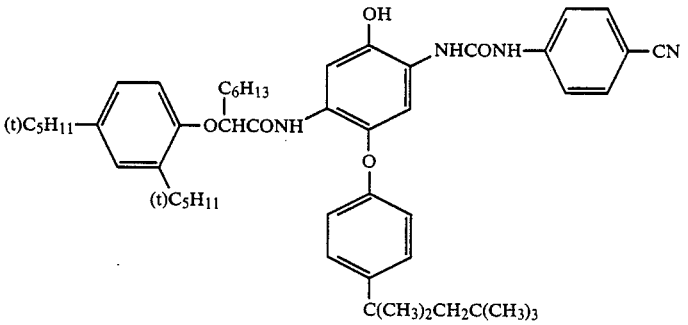
ExM-1
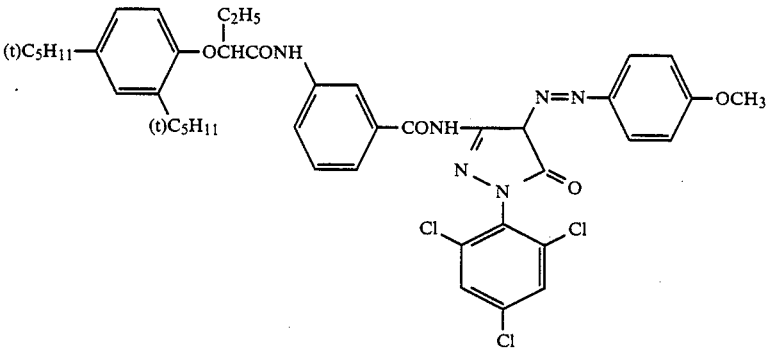

-continued
ExM-2
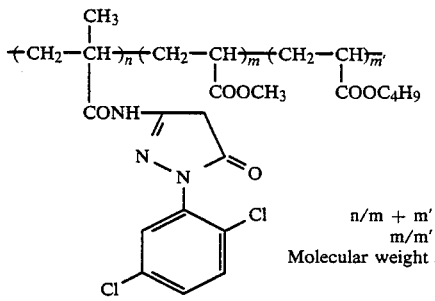
n/m + m' = 1 (by weight)
m/m' = 1 (by weight)
Molecular weight about 40,000
ExM-3
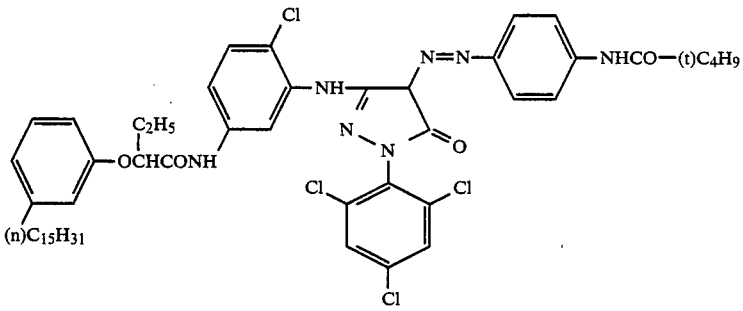
ExM-4
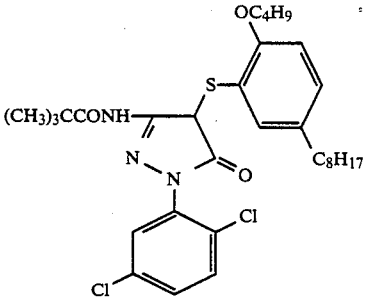
ExM-5
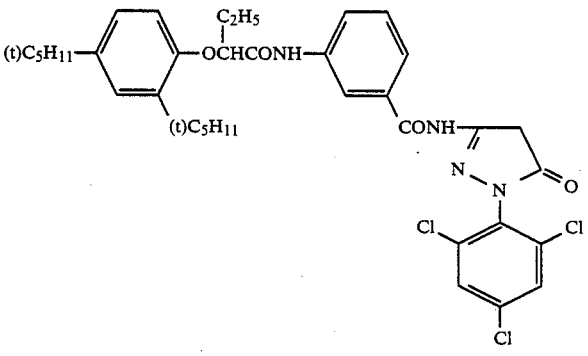
ExY-1
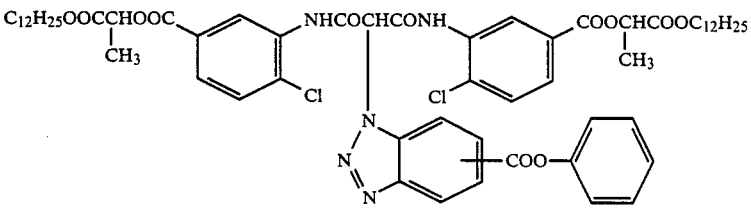

-continued
ExY-2
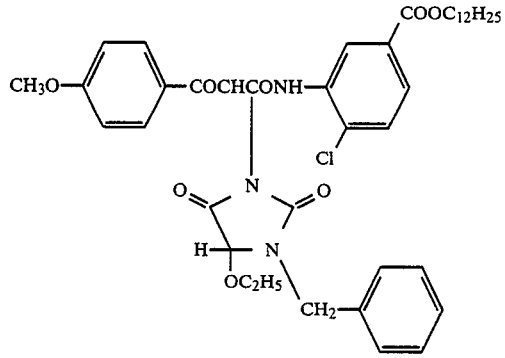
UV-1
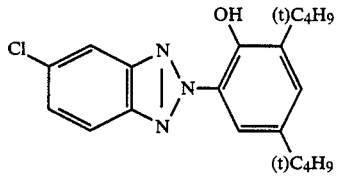
UV-2
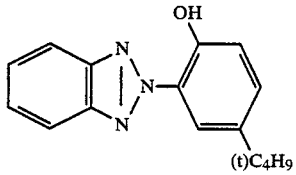
UV-3
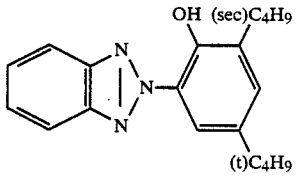
UV-4
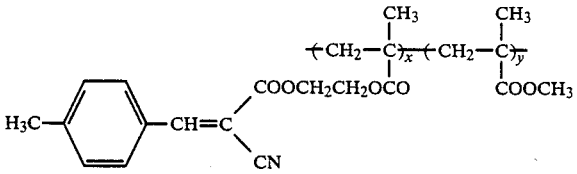
x/y = 7/3 (wt/wt)
UV-5
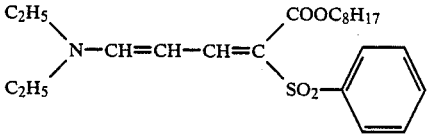
ExF-1
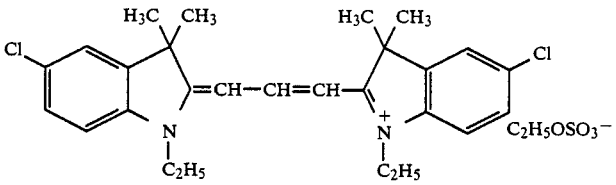
Cpd-1
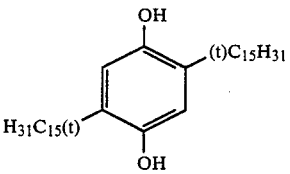

-continued

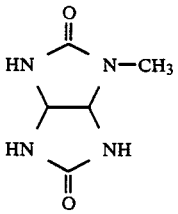

Cpd-2

Di-n-butylphthalate — Solv-1
Tricresyl phosphate — Solv-2
Trihexyl phosphate — Solv-3

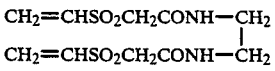

H-1

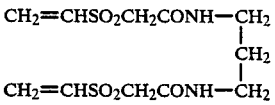

H-2

Preparation of Samples 42 and 45

Sample 42 was prepared in the same was as sample 41 except that 0.2 gram of compound A was added as a comparative compound in place of the yellow colloidal silver in the tenth layer of sample 41.

Compound A

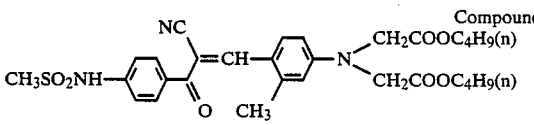

The yellow dye disclosed in
Japanese Patent Application (OPI) No. 205934/86

Sample 43 was prepared in the same way as sample 42 except that 0.2 gram of compound B was added in place of the compound A in sample 42.

Compound B

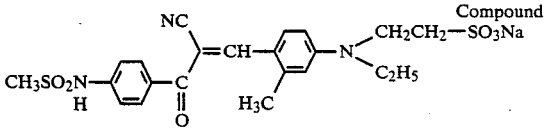

Sample 44 was prepared in the same way as sample 42 except that compound (6) of this invention was added in place of the compound A in the tenth layer of sample 42 in an equimolar amount of the compound A.

Furthermore, sample 45 was prepared in the same was as sample 42 except that compound (34) of this invention was added in place of the compound A in the tenth layer of sample 42 in an equimolar amount of the compound A.

The thus obtained samples 41 to 45 described above were exposed through an optical wedge by using a white light and then processed as follows.

| Process | Processing Time | Processing Temperature |
|---|---|---|
| | Processing Method | |
| Color development | 3 min. 15 sec. | 38° C. |
| Bleaching | 1 min. 00 sec. | 38° C. |
| Bleach-fixing | 3 min. 15 sec. | 38° C. |
| Water washing (1) | 40 sec. | 35° C. |

-continued

| Process | Processing Time | Processing Temperature |
|---|---|---|
| | Processing Method | |
| Water washing (2) | 1 min. 00 sec. | 35° C. |
| Stabilization | 40 sec. | 38° C. |
| Drying | 1 min. 15 sec. | 55° C. |

The compositions of the processing baths are given below.

| | |
|---|---|
| Color Development Bath | |
| Diethylenetriamine penta-acetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| water | to make up to 1.0 liter |
| pH | 10.05 |
| Bleaching Bath | |
| Ethylenediamine tetra-acetic acid ferric ammonium dihydrate salt | 120.0 g |
| Ethylenediamine tetra-acetic acid di-sodium salt | 10.0 g |
| Ammonium bromide | 100.0 g |
| Ammonium nitrate | 10.0 g |
| Bleach accelerator | 0.005 mol |

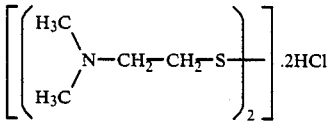

| | |
|---|---|
| Aqueous ammonia (27%) | 15.0 ml |
| Water | to make up to 1.0 liter |
| pH | 6.3 |
| Bleach-Fixing Bath | |
| Ethylenediamine tetra-acetic acid ferric ammonium dihydrate salt | 50.0 g |
| Ethylenediamine tetra-acetic acid di-sodium salt | 5.0 g |
| Sodium sulfite | 12.0 g |
| Aqueous ammonium thiosulfate solution (70%) | 240.0 ml |

-continued

| | |
|---|---|
| Aqueous ammonia (27%) | 6.0 ml |
| Water | to make up to 1.0 liter |
| pH | 7.2 |

Water Washinq Bath

Tap water was passed through a mixed bed column packed with an H-type strongly acidic cation exchange resin (Amberlite IR-120B, made by the Rohm and Haas Co.) and an OH-type anion exchange resin (Amberlite IR-400, made by the Rohm and Haas Co.) and treated in such a way that the calcium and magnesium ion concentrations were 3 mg/l or less, and then 20 mg/l of sodium dichloroisocyanurate and 150 mg/l of sodium sulfate were added. The pH of this liquid was within the range from 6.5 to 7.5.

| Stabilization Bath | |
|---|---|
| Formalin (37%) | 2.0 ml |
| Polyoxyethylene-p-monononylphenylether (average degree of polymerization 10) | 0.3 g |
| Ethylenediamine tetra-acetic acid di-sodium salt | 0.05 g |
| Water | to make up to 1.0 liter |
| pH | 5.0 to 8.0 |

The speeds of the blue sensitive layer and green sensitive layer of the samples obtained, and $D_{min}$ of the yellow density were measured and the results obtained were as shown in Table 2.

TABLE 2

| Sample No. | Compound Added to the Tenth Layer | Speed of the Blue Sensitive Layer* | Speed of the Green Sensitive Layer** | $D_{min}$ of the Yellow Density*** |
|---|---|---|---|---|
| 41 (Comparative Example) | — | ±0 | ±0 | ±0 |
| 42 (Comparative Example) | Compound A | −0.02 | +0.09 | +0.10 |
| 43 (Comparative Example) | Compound B | −0.15 | +0.08 | +0.01 |
| 44 (The Invention) | Compound (6) | −0.01 | +0.12 | +0.01 |
| 45 (The Invention) | Compound (34) | ±0.0 | +0.09 | +0.01 |

*log E for providing a density of fog +0.15 noted in comparison to that for sample 41

**log E for providing a density of fog +0.15 indicated as a relative value.

***Indicated as the difference from sample 41

The samples of this invention had blue sensitive layers of slightly lower speed than the comparative examples and the $D_{min}$ values of the yellow density were lower.

It is thought that this is because the compounds of this invention undergo little inter-layer migration from the layer to which they have been added (the tenth layer) into the adjacent layer (the blue sensitive layer) and because they have excellent decolorizing properties in the development process so that there is little residual coloration.

Furthermore, the reduction in speed of the green sensitive layer is small in comparison to that observed with colloidal silver (sample 41) but this is probably because the compounds of this invention have a better absorption cut-off on the long wavelength side.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide light-sensitive emulsion layer, wherein at least one compound represented by the formula (I) is present in said silver halide emulsion layer or at least one other hydrophilic colloid layer of said material:

$$A—B \qquad (I)$$

wherein A represents a blocking group which can release B during processing in a processing bath having a pH of 5.0 to 12.5, wherein B is a photographic dye bonded to A by means of a hetero atom and B is able to diffuse within a hydrophilic colloid layer, and wherein the compound of formula (I) is a compound represented by formula (II):

$$A\text{-}(X_1)_{m_1}\text{-}D \qquad (II)$$

wherein D, which is released during processing in a processing bath having a pH of 5.0 to 12.5, represents a photographic dye which is bonded to $X_1$ by means of a hetero atom of the dye D and D is able to diffuse within a hydrophilic colloid layer, wherein $X_1$ represents a divalent linking group which is bonded to A by means of a hetero atom of the divalent linking group $X_1$, and $m_1$ represents 0 or 1, and wherein the compound of formula (II) is a compound represented by formula (III) or (IV):

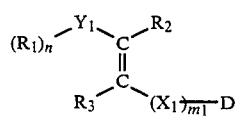

(III)

wherein $R_1$, $R_2$ and $R_3$ each represents a hydrogen atom or a substituent and $R_1$ and $R_2$ and $R_3$, may be bonded together to form a carbocyclic or heterocyclic ring, $Y_1$ represents

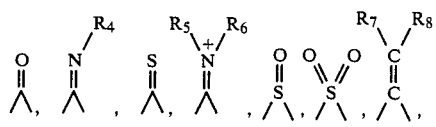

a cyano group or a nitro group (wherein $R_4$, $R_5$, $R_6$, $R_7$ and $R_8$ each represents a hydrogen atom or a substituent), n represents 0 or 1, and $X_1$, D and $m_1$ have the same meaning as in formula (II);

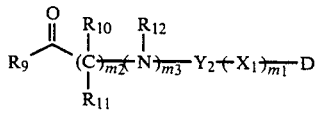

(IV)

wherein $R_9$ is a hydrogen atom, an alkyl group, an alkenyl group, an aryl group, a cycloalkyl group or a heterocyclic group, $R_{10}$, $R_{11}$ and $R_{12}$ each represents a hydrogen atom or a substituent, $Y_2$ represents a carbonyl group or a sulfonyl group, $m_2$ represents an integer of 1 to 4, $m_3$ is 0 or 1, and $X_1$, D and $m_1$ have the same meaning as in the formula (II), provided that when $m_2$ is 2, 3 or 4, the carbon atom onto which $R_{10}$ and $R_{11}$ is substituted can form a cycloalkyl group, an aromatic ring or a heterocyclic ring.

2. The photographic material as in claim 1, wherein the compound of formula (II) is a compound represented by formula (III).

3. The photographic material as in claim 2, wherein the compound of formula (III) is a compound represented by formula (V) or (VI):

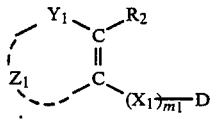

(v)

wherein $Z_1$ is a group of atoms which forms a carbocyclic or heterocyclic ring and $R_2$, $Y_1$, $X_1$, D and $m_1$ have the same meaning as in the formula (III);

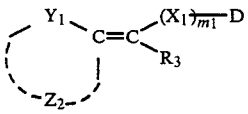

(VI)

wherein $Z_2$ is a group of atoms which form a carbocyclic or heterocyclic ring and $R_2$, $Y_1$, $X_1$, D and $m_1$ have the same meaning as in the formula (III);

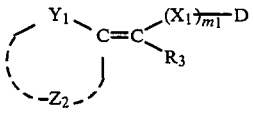

(VI)

wherein $Z_2$ is a group of atoms which forms a carbocyclic or heterocyclic ring and $R_3$, $Y_1$, $X_1$, D and $m_1$ have the same meaning as in the formula (III).

4. The photographic material as in claim 1, wherein the total number of carbon atoms in the structure of formula (II) excluding D is at least 10.

5. The photographic material as in claim 3, wherein the total number of carbon atoms in the structure of formula (V) or (VI) excluding D is at least 10.

6. The photographic material as in claim 1, wherein the compound represented by the formula (I) is present in a hydrophilic colloid layer on the opposite side of the support from the light-sensitive emulsion layer or in a hydrophilic colloid layer between the support and the light-sensitive emulsion layer.

7. The photographic material as in claim 1, wherein the silver halide light-sensitive emulsion layer of another hydrophilic colloid layer further comprises hydrazine derivatives represented by the formula (VII):

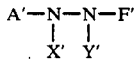

(VII)

wherein A' represents an aliphatic group or an aromatic group, F' represents a formyl group, an acyl group, an alkyl or aryl sulfonyl group, an alkyl or aryl sulfinyl group, a carbamoyl group, an alkoxy or aryloxy carbonyl group, a sulfinamoyl group, an alkoxysulfonyl group, a thioacyl group, a thiocarbamoyl group, a sulfanyl group, or a heterocyclic group, and X' and Y' both represent a hydrogen atom or one of them is a hydrogen atom and the other represents a substituted or unsubstituted alkylsulfonyl group, a substituted or unsubstituted arylsulfonyl group, or a substituted or unsubstituted acyl group, provided that F', Y' and the nitrogen atom which join them together, may form the

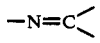

structural part of a hydrazone.

8. The photographic material as in claim 1, wherein the compound represented by formula (I) is present in a yellow filter layer.

* * * * *